US009691599B2

(12) United States Patent
Zukawa et al.

(10) Patent No.: US 9,691,599 B2
(45) Date of Patent: Jun. 27, 2017

(54) ULTRAVIOLET LIGHT EMITTING DEVICE THAT CAN SUPPRESS TIME-DEPENDENT DECREASE IN EMISSION INTENSITY DURING CONTINUOUS OPERATION

(71) Applicant: Panasonic Intellectual Property Management Co., Ltd., Osaka (JP)

(72) Inventors: Takehiro Zukawa, Osaka (JP); Yoshiki Sasaki, Osaka (JP); Nobuaki Nagao, Gifu (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/073,613

(22) Filed: Mar. 17, 2016

(65) Prior Publication Data

US 2016/0300704 A1 Oct. 13, 2016

(30) Foreign Application Priority Data

Apr. 8, 2015 (JP) ..... 2015-079584

(51) Int. Cl.
*H01J 61/44* (2006.01)
*H01J 61/16* (2006.01)
*H01J 65/00* (2006.01)

(52) U.S. Cl.
CPC ..... *H01J 61/44* (2013.01); *H01J 61/16* (2013.01); *H01J 65/00* (2013.01)

(58) Field of Classification Search
CPC .. H01J 61/44; H01J 61/16; H01J 65/00; H01J 61/305; H01J 61/302
See application file for complete search history.

(56) References Cited

U.S. PATENT DOCUMENTS

2005/0010249 A1 1/2005 Minamoto et al.
2006/0195166 A1 8/2006 Minamoto et al.
2009/0179547 A1 7/2009 Auday et al.
2010/0102310 A1* 4/2010 Komatsu ..... H01L 51/5088 257/43
2010/0237368 A1* 9/2010 Kojima ..... H01L 33/486 257/98

(Continued)

FOREIGN PATENT DOCUMENTS

JP 2001-015068 1/2001
JP 2001-081460 3/2001

(Continued)

*Primary Examiner* — Tracie Y Green
(74) *Attorney, Agent, or Firm* — McDermott Will & Emery LLP

(57) ABSTRACT

An ultraviolet light emitting device comprises: a first substrate having a main surface; a second substrate facing the main surface of the first substrate; a gas in a space between the first substrate and the second substrate; electrodes directly or indirectly on the main surface of the first substrate; a dielectric layer that is located directly or indirectly on the main surface of the first substrate and covers the electrodes; and a first light-emitting layer. The first light-emitting layer is located directly or indirectly on the dielectric layer and emits ultraviolet light in the gas due to electrical discharge between the electrodes. The first light-emitting layer is thicker in first regions on the dielectric layer than in second regions. The second regions include at least part of regions directly above the electrodes.

10 Claims, 13 Drawing Sheets

(56) References Cited

U.S. PATENT DOCUMENTS

| | | | | |
|---|---|---|---|---|
| 2011/0227501 | A1 | 9/2011 | Awamoto et al. | |
| 2016/0300704 | A1* | 10/2016 | Zukawa | H01J 61/44 |
| 2016/0300705 | A1* | 10/2016 | Zukawa | H01J 61/44 |
| 2016/0339138 | A1* | 11/2016 | Nagao | A61L 12/063 |

FOREIGN PATENT DOCUMENTS

| | | |
|---|---|---|
| JP | 2001-172624 | 6/2001 |
| JP | 2004-350946 | 12/2004 |
| JP | 2006-087472 | 4/2006 |
| JP | 2009-505365 | 2/2009 |
| JP | 2011-193929 | 10/2011 |

* cited by examiner

FIG. 9

| | MATERIAL OF LIGHT-EMITTING LAYER | THICKNESS OF LIGHT-EMITTING LAYER | | INITIAL DISCHARGE VOLTAGE | INITIAL EMISSION INTENSITY | EMISSION INTENSITY AFTER CONTINUOUS EMISSION (1000 h) | DETERIORATION RATE |
|---|---|---|---|---|---|---|---|
| | | DIRECTLY ABOVE ELECTRODE (SECOND REGION) | OTHER REGION (FIRST REGION) | | | | |
| COMPARATIVE EXAMPLE 1 | $YBO_3$: Gd | 30 μm | 30 μm | 425 V | 100 | 50 | 50% |
| COMPARATIVE EXAMPLE 2 | MgO POWDER | 30 μm | 30 μm | 370 V | 170 | 51 | 30% |
| EXAMPLE 1 | $YBO_3$: Gd | 8 μm | 30 μm | 330 V | 80 | 60 | 75% |
| EXAMPLE 2 | MgO POWDER | 12 μm | 30 μm | 330 V | 150 | 60 | 40% |
| EXAMPLE 3 | MgO POWDER | 8 μm | 30 μm | 300 V | 140 | 119 | 85% |
| EXAMPLE 4 | MgO POWDER | 0 μm | 30 μm | 250 V | 120 | 114 | 95% |

FIG. 11

| | MATERIAL OF LIGHT-EMITTING LAYER | | THICKNESS OF LIGHT-EMITTING LAYER | | INITIAL DISCHARGE VOLTAGE | INITIAL EMISSION INTENSITY | EMISSION INTENSITY AFTER CONTINUOUS EMISSION (1000 h) | DETERIORATION RATE |
|---|---|---|---|---|---|---|---|---|
| | DIRECTLY ABOVE ELECTRODE (SECOND REGION) | OTHER REGION (FIRST REGION) | DIRECTLY ABOVE ELECTRODE (SECOND REGION) | OTHER REGION (FIRST REGION) | | | | |
| COMPARATIVE EXAMPLE 2 | MgO POWDER CONTAINING F | MgO POWDER CONTAINING F | 100 | 100 | 370 V | 100 | 30 | 30% |
| EXAMPLE 5 | MgO POWDER FREE OF F | MgO POWDER CONTAINING F | 60 | 100 | 330 V | 80 | 60 | 75% |

FIG. 13

| | MATERIAL OF LIGHT-EMITTING LAYER | PROTECT LAYER ON LIGHT-EMITTING LAYER | INITIAL DISCHARGE VOLTAGE | INITIAL EMISSION INTENSITY | EMISSION INTENSITY AFTER CONTINUOUS EMISSION (1000 h) | DETERIORATION RATE |
|---|---|---|---|---|---|---|
| COMPARATIVE EXAMPLE 1 | $YBO_3$: Gd | NONE | 425 V | 100 | 100 | 50% |
| COMPARATIVE EXAMPLE 2 | MgO POWDER | NONE | 370 V | 170 | 180 | 30% |
| EXAMPLE 6 | $YBO_3$: Gd | MgO THIN FILM | 400 V | 100 | 130 | 85% |
| EXAMPLE 7 | MgO POWDER | MgO THIN FILM | 350 V | 170 | 200 | 75% |

ULTRAVIOLET LIGHT EMITTING DEVICE THAT CAN SUPPRESS TIME-DEPENDENT DECREASE IN EMISSION INTENSITY DURING CONTINUOUS OPERATION

BACKGROUND

1. Technical Field

The present disclosure relates to an ultraviolet light emitting device.

2. Description of the Related Art

Deep ultraviolet light having a wavelength of approximately 200 to 350 nm is utilized in various fields of sterilization, water purification, lithography, and illumination. Hitherto, mercury lamps have been widely used as deep ultraviolet light sources. Mercury lamps utilize a mercury glow discharge. From the perspective of the reduction of load on the environment, however, regulations for environmentally hazardous substances, such as mercury, are being tightened up, as in WEEE & RoHS directives in Europe. Thus, there is a demand for alternative light sources to mercury lamps. Mercury lamps are point emission sources. For lithography, which requires wide and uniform intensity light, therefore, mercury lamps require complex light source design.

An example of deep ultraviolet light sources free of mercury may be a deep ultraviolet light emitting diode (DUV-LED). Another example of deep ultraviolet light sources free of mercury may be an excimer lamp, which emits deep ultraviolet light by excitation of a discharge gas, such as krypton chloride (KrCl), by barrier discharge.

Still another deep ultraviolet light source free of mercury may be a deep ultraviolet light emitting device that includes a phosphor in combination with barrier discharge (see, for example, Japanese Unexamined Patent Application Publication (Translation of PCT Application) No. 2009-505365 and Japanese Unexamined Patent Application Publication No. 2011-193929). This deep ultraviolet light emitting device emits deep ultraviolet light by irradiating the phosphor with vacuum ultraviolet light generated by excitation of a noble gas, such as xenon (Xe), by barrier discharge.

More specifically, Japanese Unexamined Patent Application Publication (Translation of PCT Application) No. 2009-505365 discloses a light-emitting device that produces surface-emitted ultraviolet light by applying an alternating voltage to electrodes on a substrate in a discharge space to cause electrical discharge. The discharge space contains a phosphor that emits ultraviolet light. Japanese Unexamined Patent Application Publication No. 2011-193929 discloses a surface-emitting device that includes long discharge tubes arranged in parallel. The long discharge tubes include a light-emitting layer that emits ultraviolet light. Deep ultraviolet light is produced by irradiating the light-emitting layer with vacuum ultraviolet light generated by electrical discharge. Such deep ultraviolet light emitting devices that include a phosphor in combination with barrier discharge advantageously have a high degree of freedom of shape due to flexible arrangement of local electrical discharge and possibly require no complex light source design.

SUMMARY

One non-limiting and exemplary embodiment provides an ultraviolet light emitting device that can suppress time-dependent decrease in emission intensity.

In one general aspect, the techniques disclosed here feature an ultraviolet light emitting device that includes a first substrate having a main surface, a second substrate facing the main surface of the first substrate, a gas in a space between the first substrate and the second substrate, electrodes directly or indirectly on the main surface of the first substrate, a dielectric layer that is located directly or indirectly on the main surface of the first substrate and covers the electrodes, and a first light-emitting layer that is located directly or indirectly on the dielectric layer and emits ultraviolet light in the gas due to electrical discharge between the electrodes. The first light-emitting layer may have an uneven surface facing the second substrate due to being thicker in first regions on the dielectric layer than in second regions different from the first regions, the second regions including at least part of regions directly above the electrodes. Alternatively, the first light-emitting layer may be absent in second regions but present in first regions on the dielectric layer different from the second regions, the second regions including at least part of regions directly above the electrodes. Further alternatively, a thin film containing at least one of magnesium oxide, calcium oxide, barium oxide, and strontium oxide may be located directly or indirectly on the first light-emitting layer.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF THE DRAWINGS

FIG. 9 is a table of the characteristic evaluation results for ultraviolet light emitting devices according to the first embodiment, modified examples thereof, and comparative examples;

FIG. 11 is a table of the characteristic evaluation results for ultraviolet light emitting devices according to the second embodiment and a comparative example;

FIG. 13 is a table of the characteristic evaluation results for ultraviolet light emitting devices according to the third embodiment and comparative examples.

DETAILED DESCRIPTION

Outline of Present Disclosure

Figure 1:
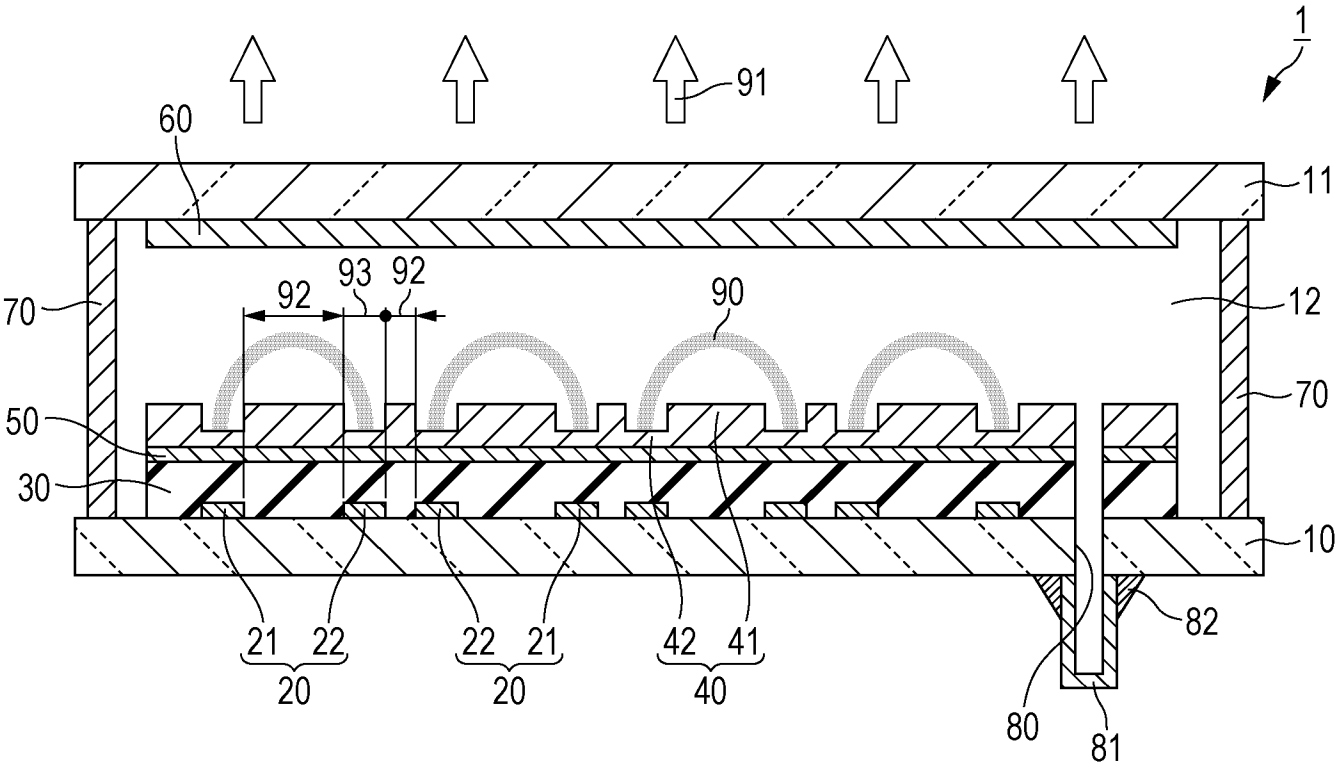
FIG. 1 is a schematic cross-sectional view of an ultraviolet light emitting device according to a first embodiment.

The outline of an ultraviolet light emitting device according to the present disclosure will be described below.

The present inventors found that the deep ultraviolet light emitting devices disclosed in Japanese Unexamined Patent Application Publication (Translation of PCT Application) No. 2009-505365 and Japanese Unexamined Patent Application Publication No. 2011-193929 cannot suppress the time-dependent decrease in emission intensity during continuous emission. In other words, the present inventors found that as in the ultraviolet light emitting devices disclosed in Japanese Unexamined Patent Application Publication (Translation of PCT Application) No. 2009-505365 and Japanese Unexamined Patent Application Publication No. 2011-193929, a light-emitting layer on a dielectric layer covering electrodes deteriorates on exposure to ion bombardment caused by electrical discharge. The present inventors found that the emission intensity of such ultraviolet light emitting devices decreases over time during continuous emission.

Furthermore, the initial discharge voltage of such ultraviolet light emitting devices is affected by the secondary electron emission characteristics of a region exposed to electrical discharge around the dielectric layer covering electrodes. Thus, when a light-emitting layer is formed directly above a dielectric layer or protective layer covering electrodes, deterioration of the secondary electron emission characteristics increases the initial discharge voltage. Furthermore, because wall charges for continuing electrical discharge are accumulated in a portion of a dielectric layer directly above electrodes, a light-emitting layer on the dielectric layer directly above electrodes interrupts electrical discharge.

Thus, the emission intensity of the ultraviolet light emitting devices disclosed in Japanese Unexamined Patent Application Publication (Translation of PCT Application) No. 2009-505365 and Japanese Unexamined Patent Application Publication No. 2011-193929 decreases greatly over time during continuous emission. Furthermore, the voltage for initiating electrical discharge (initial discharge voltage) and the voltage for sustaining electrical discharge (discharge sustaining voltage) are also increased, and this decreases the emission intensity of ultraviolet light emitting devices.

Accordingly, the present disclosure solves these problems by providing an ultraviolet light emitting device that can suppress the time-dependent decrease in emission intensity during continuous emission.

An ultraviolet light emitting device according to one aspect of the present disclosure includes a first substrate having a main surface, a second substrate facing the main surface of the first substrate, a gas in a space between the first substrate and the second substrate, electrodes directly or indirectly on the main surface of the first substrate, a dielectric layer that is located directly or indirectly on the main surface of the first substrate and covers the electrodes, and a first light-emitting layer that is located directly or indirectly on the dielectric layer and emits ultraviolet light in the gas due to electrical discharge between the electrodes. The first light-emitting layer may have an uneven surface facing the second substrate due to being thicker in first regions on the dielectric layer than in second regions different from the first regions. The second regions include at least part of regions directly above the electrodes.

Thus, the light-emitting layer is thinner in the second regions including at least part of regions directly above the electrodes. This can decrease the ratio of the emission intensity in the second regions to the emission intensity of the entire ultraviolet light emitting device. Thus, even if the emission intensity in the second regions of the light-emitting layer decreases over time during continuous emission, this does not significantly affect the emission intensity of the entire ultraviolet light emitting device, and the time-dependent decrease in emission intensity during continuous emission can be suppressed. For example, more than 50%, 70% or 90% of an area of the second regions may be directly above the electrodes. More than 50%, 70% or 90% of an area of the first regions may not be directly above the electrodes.

Because the light-emitting layer is thinner in the second regions, the initial discharge voltage is more influenced by the dielectric layer directly under the light-emitting layer. Thus, when the dielectric layer has better secondary electron emission characteristics than the light-emitting layer, the initial discharge voltage can be decreased.

For example, the first light-emitting layer may have a thickness of less than 10 μm in the second regions.

When the light-emitting layer has a thickness of less than 10 μm in the second regions, ultraviolet light emitted from the light-emitting layer can be easily transmitted. Because ultraviolet light directed toward the electrodes is absorbed by the dielectric layer, the emission intensity in the second regions can be lowered in advance. This can further decrease the ratio of the emission intensity in the second regions to the emission intensity of the entire ultraviolet light emitting device and thereby suppress the time-dependent decrease in emission intensity during continuous emission.

Alternatively, the first light-emitting layer may be absent in second regions but present in first regions on the dielectric layer different from the second regions. The second regions include at least part of regions directly above the electrodes. For example, more than 50%, 70% or 90% of an area of the second regions may be directly above the electrodes. More than 50%, 70% or 90% of an area of the first regions may not be directly above the electrodes.

In this case, the light-emitting layer is absent in the second region or directly above the electrodes. This can decrease the ratio of the emission intensity in the second regions to the emission intensity of the entire ultraviolet light emitting device to approximately zero and thereby suppress the time-dependent decrease in emission intensity during continuous emission.

The ultraviolet light emitting device may further include a second light-emitting layer in the second regions, wherein the second light-emitting layer contains a different type or amount of material from the first light-emitting layer and has a lower ultraviolet emission intensity than the first light-emitting layer.

Since the emission intensity of the second light-emitting layer in the second regions directly above the electrodes is lower than the emission intensity of the first light-emitting layer in the first region not directly above the electrodes, the ratio of the emission intensity in the second regions to the emission intensity of the entire ultraviolet light emitting device can be decreased. Thus, the time-dependent decrease in emission intensity during continuous emission can be suppressed.

Each of the first light-emitting layer and the second light-emitting layer may contain a halogen atom and powdered magnesium oxide that emits the ultraviolet light, and the second light-emitting layer may contain a smaller number of halogen atoms than the first light-emitting layer.

Thus, the number of halogen atoms can be changed to adjust the emission intensity of the second light-emitting layer.

Each of the first light-emitting layer and the second light-emitting layer may contain powdered magnesium oxide that emits the ultraviolet light, the first light-emitting layer may further contain a halogen atom, and the second light-emitting layer may contain no halogen atom.

Thus, the emission intensity of the second light-emitting layer can be sufficiently lower than the emission intensity of the first light-emitting layer. This can further decrease the ratio of the emission intensity in the second regions to the emission intensity of the entire ultraviolet light emitting device and thereby suppress the time-dependent decrease in emission intensity during continuous emission.

The ultraviolet light emitting device may further include a thin film that is located between the first light-emitting layer and the dielectric layer and contains at least one of magnesium oxide, calcium oxide, barium oxide, and strontium oxide.

The thin film serving as a protective layer can decrease the change in secondary electron emission characteristics and thereby suppress the decrease in discharge intensity during continuous emission.

The ultraviolet light emitting device may further include a thin film that is located directly or indirectly on the first light-emitting layer and contains at least one of magnesium oxide, calcium oxide, barium oxide, and strontium oxide. The thin film may be located in third regions and is not located in fourth regions on the first light-emitting layer different from the third regions. The third regions include at least part of regions directly above the electrodes. The second or third regions may include all the regions directly above the electrodes. For example, more than 50%, 70% or 90% of an area of the third regions may be directly above the electrodes. More than 50%, 70% or 90% of an area of the fourth regions may not be directly above the electrodes.

The thin film serving as a protective layer located directly or indirectly on the first light-emitting layer can protect the first light-emitting layer from direct exposure to electrical discharge. This can suppress the degradation of the first light-emitting layer and suppress the time-dependent decrease in emission intensity during continuous emission.

The first light-emitting layer may contain powdered magnesium oxide that emits the ultraviolet light.

Magnesium oxide has good secondary electron emission characteristics and can lower the initial discharge voltage. Magnesium oxide is resistant to ion bombardment and can suppress the degradation of the light-emitting layer due to ion bombardment caused by electrical discharge.

The first light-emitting layer may further contain a halogen atom.

The powdered magnesium oxide containing a halogen atom can strengthen ultraviolet emission.

The halogen atom may be fluorine.

The powdered magnesium oxide containing fluorine can strengthen ultraviolet emission.

The second substrate may have a first main surface facing the first substrate and a second main surface opposite to the first main surface. The first main surface faces the first substrate. The ultraviolet light emitting device may further include a third light-emitting layer that is located directly or indirectly on the first or second main surface of the second substrate and emits the ultraviolet light.

This can further decrease the proportion of emission intensity in the second regions and suppress the time-dependent change in the emission intensity of the ultraviolet light emitting device.

The gas may contain neon and xenon.

A gas mixture of neon and xenon emits excitation light having a wavelength of approximately 147 nm during electrical discharge. Since a MgO powder efficiently emits light in response to excitation light having a wavelength of approximately 150 nm, the gas mixture can increase the emission intensity.

The ultraviolet light may have a peak wavelength in the range of 200 to 300 nm.

This allows the ultraviolet light emitting device to be effectively used particularly for sterilization, water purification, and lithography.

The embodiments of the present disclosure will be more specifically described with reference to the accompanying drawings.

The following embodiments are general or specific examples. The numerical values, shapes, materials, components, arrangement and connection of the components, steps, and sequential order of steps in the following embodiments are only examples and are not intended to limit the present disclosure. Among the components in the following embodiments, components not described in the highest level concepts of the independent claims are described as optional components.

The accompanying figures are schematic figures and are not necessarily precise figures. The same reference numerals denote the same or equivalent parts throughout the figures.

The term "above" or "over" and "below" or "under", as used herein, does not necessarily indicate upward (vertically upward) and downward (vertically downward) in the sense of absolute spatial perception but indicates the relative positional relationship based on the stacking sequence in multilayer structures. More specifically, "above" or "over" indicates the direction perpendicular to the main surface of the first substrate and the direction from the first substrate to the second substrate, and "below" or "under" indicates the opposite direction. The term "over", "under", or "on", as used herein, indicates not only a case where two components are disposed with a space therebetween but also a case where two components are in contact with each other.

First Embodiment

1. Structure

1-1. Outline

An ultraviolet light emitting device according to a first embodiment of the present disclosure will be described below with reference to FIG. 1. FIG. 1 is a schematic cross-sectional view of an ultraviolet light emitting device 1 according to the present embodiment.

In the ultraviolet light emitting device 1, a phosphor is used in combination with barrier discharge. As illustrated in FIG. 1, the ultraviolet light emitting device 1 includes a first substrate 10, a second substrate 11, electrodes 20, a dielectric layer 30, a light-emitting layer 40, a protective layer 50, a light-emitting layer 60, a sealing member 70, and a tip tube 81.

In the ultraviolet light emitting device 1, the first substrate 10 and the second substrate 11 are joined together with the sealing member 70, thus forming a discharge space 12. The electrodes 20 to which a voltage is applied to cause electrical discharge 90 are located on the first substrate 10 and are covered with the dielectric layer 30. The protective layer 50 and the light-emitting layer 40 are located on a surface of the dielectric layer 30 facing the discharge space 12. The protective layer 50 protects the dielectric layer 30 from ion bombardment. The light-emitting layer 40 emits ultraviolet light.

Ultraviolet light from the light-emitting layer 40 and the light-emitting layer 60 is emitted outside the device from the second substrate 11 (ultraviolet light 91 in FIG. 1). The ultraviolet light 91 is deep ultraviolet light having a peak wavelength in the range of 200 to 350 nm. For example, the ultraviolet light 91 has a peak wavelength in the range of 200 to 300 nm.

The components of the ultraviolet light emitting device 1 will be described in detail below.

1-2. Substrate

A main surface of the first substrate 10 faces a main surface of the second substrate 11. In the present embodiment, the second substrate 11 faces the light-emitting layer 40. The first substrate 10 is separated by a predetermined distance from the second substrate 11. For example, the predetermined distance is 1 mm. In the present embodiment, the first substrate 10 and the second substrate 11 are flat sheets. The first substrate 10 may have almost the same shape and size as the second substrate 11.

The first substrate 10 is hermetically bonded to the second substrate 11 with the sealing member 70. Thus, the discharge space 12 is formed between the first substrate 10 and the second substrate 11. The discharge space 12 contains a discharge gas, such as xenon (Xe), krypton chloride (KrCl), fluorine ($F_2$), neon (Ne), helium (He), carbon monoxide (CO), nitrogen ($N_2$), or any combination thereof, at a predetermined pressure. In the present embodiment, the discharge space 12 may be filled with a gas containing neon and xenon.

At least one of the first substrate 10 and the second substrate 11 is formed of a material that is transparent to ultraviolet light emitted from the light-emitting layer 40 and the light-emitting layer 60 in order to emit the ultraviolet light outside the device. Examples of the material that is transparent to ultraviolet light include special glass that is transparent to ultraviolet light, quartz glass ($SiO_2$), magnesium fluoride ($MgF_2$), calcium fluoride ($CaF_2$), lithium fluoride (LiF), or sapphire glass ($Al_2O_3$). These materials may be used in the first substrate 10 or the second substrate 11 or both. When these materials are used in one of the first substrate 10 and the second substrate 11, the material of the other substrate may be a general high-strain-point glass.

In the present embodiment, the second substrate 11 is formed of sapphire, which is transparent to deep ultraviolet light emitted from the light-emitting layer 40 and the light-emitting layer 60, in order to emit the deep ultraviolet light outside the device. The first substrate 10 is formed of a general low-melting-point high-strain-point glass. The occurrence of cracks and fissures in the protective layer 50 and the sealing member 70 can be reduced when the first substrate 10 or the second substrate 11 is formed of a glass having a typical thermal expansion coefficient or sapphire, which has a thermal expansion coefficient close to the thermal expansion coefficient of a MgO thin film of the protective layer 50.

1-3. Electrodes

The electrodes 20 are located between the dielectric layer 30 and the first substrate 10. More specifically, the electrodes 20 are located on the main surface of the first substrate 10. The main surface of the first substrate 10 is a surface (top surface) of the first substrate 10 facing the second substrate 11 or the discharge space 12.

The electrodes 20 are covered with the dielectric layer 30. Although the electrodes 20 are in contact with the main surface of the first substrate 10 in the present embodiment, the electrodes 20 may be separated from the first substrate 10. For example, a buffer layer, such as an insulating film, may be located between the electrodes 20 and the main surface of the first substrate 10.

As illustrated in FIG. 1, each of the electrodes 20 includes a pair of electrodes: a first electrode 21 and a second electrode 22. Different voltages are applied to the first electrode 21 and the second electrode 22.

Figure 2:
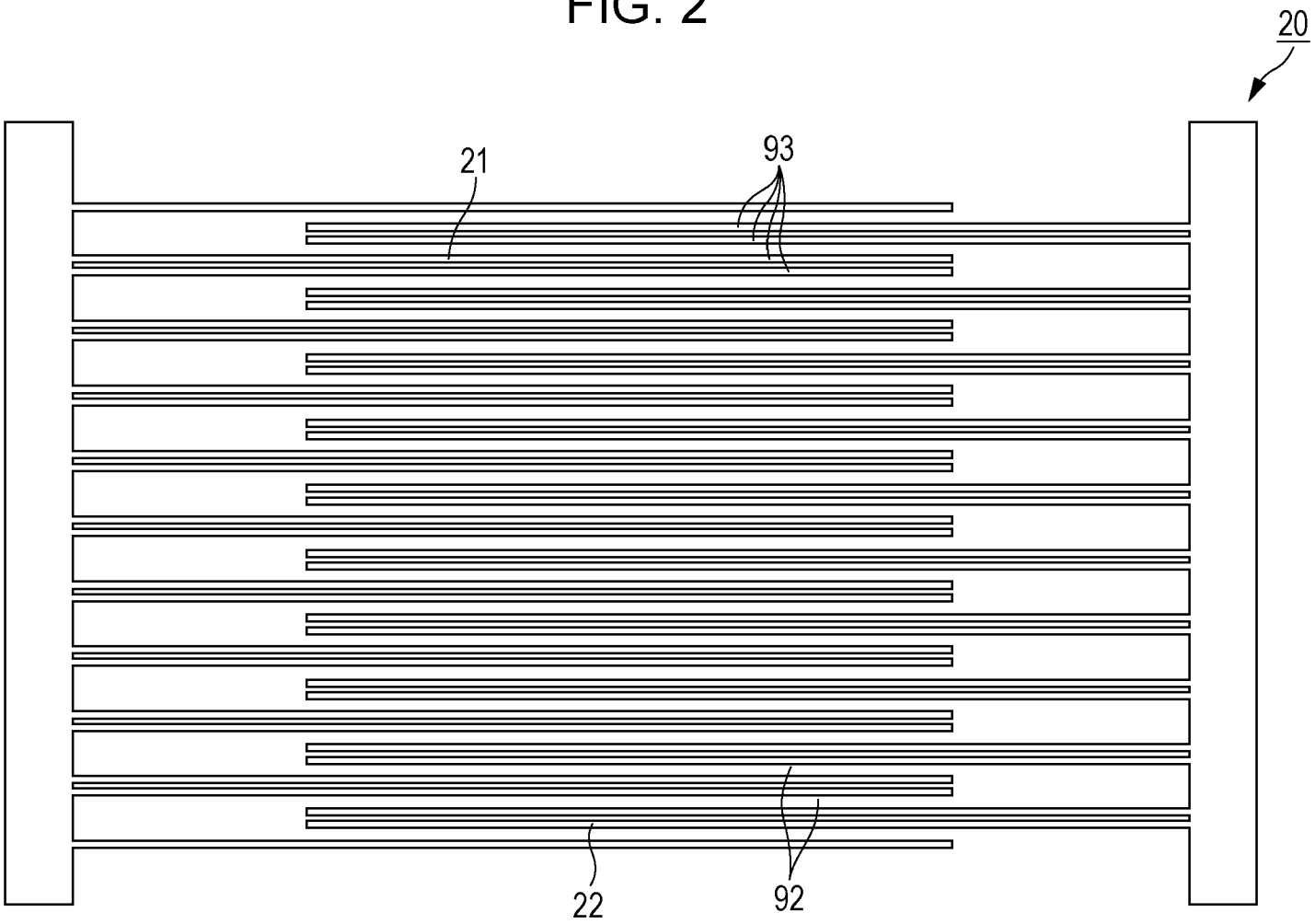
FIG. 2 is a schematic plan view of electrodes of the ultraviolet light emitting device according to the first embodiment.

FIG. 2 is a schematic plan view of the electrodes 20 of the ultraviolet light emitting device 1 according to the present embodiment. As illustrated in FIG. 2, for example, the electrodes 20 include pairs of strip electrodes (or linear electrodes having a predetermined width) arranged in parallel. More specifically, two parallel first strip electrodes 21 and two parallel second strip electrodes 22 are alternately arranged. The first electrodes 21 are electrically connected at one end so as to have the same voltage. More specifically, the first electrodes 21 have a comb-like structure. The second electrodes 22 also have a comb-like structure.

The material of the electrodes 20 may be a thick Ag film or a thin metal film, such as an Al thin film or a Cr/Cu/Cr multilayer thin film. For example, each of the electrodes 20 has a thickness of several micrometers. For example, the distance between the first electrode 21 and adjacent second electrode 22 ranges from approximately 0.1 mm to several millimeters.

An alternating wave, such as a rectangular wave or a sine wave, is applied to the electrodes 20 by a drive circuit (not shown). In general, when the phase of the voltage applied to a first electrode 21 is opposite to the phase of the voltage applied to the second electrode 22 in the same pair, light emission is enhanced. Electrical discharge can also be induced when a rectangular voltage is applied to the first electrodes 21 while the second electrodes 22 are grounded. The electrode 20 does not necessarily include a pair of electrodes. The electrode 20 may include a group of three or more strip electrodes in order to change the discharge area or to lower the initial discharge voltage.

1-4. Dielectric Layer

The dielectric layer 30 is located between the first substrate 10 and the second substrate 11. In the present embodiment, the dielectric layer 30 is located on the main surface of the first substrate 10 and covers the electrodes 20. More specifically, the dielectric layer 30 is in contact with the main surface of the first substrate 10 in such a manner as to cover the electrodes 20.

The dielectric layer 30 may be formed from a low-melting-point glass composed mainly of lead oxide (PbO), bismuth oxide ($Bi_2O_3$), or phosphorus oxide ($PO_4$) by a screen printing method and may have a thickness of approximately 30 μm. When the electrodes 20 are covered with such an insulating material of the dielectric layer 30, the electrical discharge becomes barrier discharge. In barrier discharge, the electrodes 20 are not directly exposed to ions, thus resulting in a small time-dependent change in emission intensity during continuous emission. Thus, barrier discharge is suitable for applications that require long-term continuous emission, such as sterilization devices and lithography. The thickness of the dielectric layer 30 has an influence on the electric field strength applied to the discharge space 12 and depends on the size of the device (for example, the size of the first substrate 10 and the second substrate 11) and the desired characteristics.

1-5. Light-Emitting Layer

The light-emitting layer 40 is located on the dielectric layer 30 and is an example of the first light-emitting layer that emits ultraviolet light. In the present embodiment, the light-emitting layer 40 is located on the protective layer 50, which is located on the dielectric layer 30. The light-emitting layer 40 may be in contact with the dielectric layer 30 without the protective layer 50.

The light-emitting layer 60 is located on the main surface of the second substrate 11 and is an example of the third light-emitting layer that emits ultraviolet light. The main surface of the second substrate 11 is a surface (bottom surface) of the second substrate 11 facing the first substrate 10 or the discharge space 12. The light-emitting layer on the second substrate 11 can enhance emission intensity. The light-emitting layer 60 may be located opposite the main surface of the second substrate 11. In other words, the light-emitting layer 60 may be located outside the discharge space 12 of the ultraviolet light emitting device 1. When powdered MgO is used in the light-emitting layer 60, it is desirable that the powdered MgO be located in the discharge space 12 on the electrical discharge side of the second substrate 11 because the powdered MgO is susceptible to carbonation in the air.

From the perspective of luminous efficiency and simplicity of the production process, the material of the light-emitting layer 40 and the light-emitting layer 60 may be a phosphor that emits ultraviolet light. The phosphor may be $YPO_4$:Pr, $YPO_4$:Nd, $LaPO_4$:Pr, $LaPO_4$:Nd, $YF_3$:Ce, $SrB_6O_{10}$:Ce, YOBr:Pr, $LiSrAlF_6$:Ce, $LiCaAlF_6$:Ce, $LaF_3$:Ce, $Li_6Y(BO_3)_3$:Pr, $BaY_2F_8$:Nd, YOCl:Pr, $YF_3$:Nd, $LiYF_4$:Nd, $BaY_2F_8$:Pr, $K_2YF_5$:Pr, or $LaF_3$:Nd each doped with a rare-earth luminescent center. The phosphor may also be MgO, ZnO, AlN, diamond, or BN, which emits light due to a crystal defect or a band gap.

In the present embodiment, the light-emitting layer 40 and the light-emitting layer 60 contain powdered magnesium oxide (MgO) that emits ultraviolet light. The light-emitting layer 40 and the light-emitting layer 60 may further contain a halogen atom. The halogen atom may be fluorine (F).

The light-emitting layer 40 and the light-emitting layer 60 emit light due to electrical discharge between the electrodes 20 in the discharge space 12 filled with the gas. More specifically, the phosphor in the light-emitting layer 40 and the light-emitting layer 60 emits ultraviolet light by irradiation with excitation light resulting from electrical discharge. For example, the light-emitting layer 40 and the light-emitting layer 60 emit ultraviolet light having a peak wavelength in the range of 200 to 300 nm (deep ultraviolet light). For example, the excitation light is vacuum ultraviolet light or deep ultraviolet light.

The light-emitting layer 40 is thinner in second regions 93 directly above the electrodes 20 than in first regions 92 not directly above the electrodes 20. Thus, the light-emitting layer 40 has an uneven surface facing the second substrate 11. The first regions 92 are located between the electrodes 20 when viewed from the top. The planar shapes of the second regions 93 are identical to the planar shapes of the electrodes 20. As illustrated in FIG. 2, the planar shapes of the first regions 92 and the second regions 93 are parallel strips arranged at predetermined intervals. It goes without saying that the second regions 93 are not necessarily identical to the planar shapes of the electrodes 20 in consideration of the production process. More specifically, the second regions 93 may be narrower or wider than the planar shapes of the electrodes 20. In other words, the second regions 93 include at least part of regions directly above the electrodes 20. In particular, if the second regions 93 include all the regions directly above the electrodes 20, this can enhance the advantages of the present embodiment. The first regions 92 are regions different from the second regions 93 on the dielectric layer 30.

In the present embodiment, as illustrated in FIG. 1, the light-emitting layer 40 includes first light-emitting portions 41 in the first regions 92 and second light-emitting portions 42 in the second regions 93. The second light-emitting portions 42 have a smaller thickness than the first light-emitting portions 41. For example, the first light-emitting portions 41 have a thickness in the range of approximately 20 to 30 μm, whereas the second light-emitting portions 42 have a thickness of less than 10 μm.

In the present embodiment, the materials and the amounts of the materials contained in the first light-emitting portions 41 are almost same as those contained in the second light-emitting portions 42. The "amount(s) of material(s)" in this specification does not mean the whole amount(s) of the material(s) but the amount(s) of the material(s) per unit volume. For example, the first light-emitting portions 41 contains the same materials as those of the second light-emitting portions 42, and the material ratios (for example, the component ratios or compositions) in the first light-emitting portions 41 are almost the same as those of the second light-emitting portions 42. In other words, the first light-emitting portions 41 and the second light-emitting portions 42 are formed of the same materials.

1-6. Protective Layer

The protective layer 50 is a thin film between the light-emitting layer 40 and the dielectric layer 30. The protective layer 50 functions to decrease the voltage that causes electrical discharge (initial discharge voltage) and protect the dielectric layer 30 and the electrodes 20 from ion bombardment caused by electrical discharge.

The protective layer 50 is a thin film that contains at least one of magnesium oxide (MgO), calcium oxide (CaO), barium oxide (BaO), and strontium oxide (SrO). The protective layer 50 may be a mixed-phase thin film containing two or more of MgO, CaO, BaO, and SrO. In particular, a MgO thin film has high ion bombardment resistance and can provide an ultraviolet light emitting device that has a very small time-dependent decrease in discharge intensity. The protective layer 50 may have a thickness of 1 μm.

Although the protective layer 50 and the light-emitting layer 40 are composed mainly of MgO, they have different film qualities. For example, the light-emitting layer 40 contains powdered MgO, has many defect levels, and has a poor film quality. Thus, the light-emitting layer 40 can easily release electrons and emit ultraviolet light. In contrast, the protective layer 50 may be formed of a MgO thin film and has a better film quality than the light-emitting layer 40. Thus, the protective layer 50 can protect the dielectric layer 30 from ions passing through the light-emitting layer 40.

1-7. Sealing Member

The sealing member 70 holds the first substrate 10 and the second substrate 11 at a predetermined distance. The sealing member 70 is located circularly along the periphery of the first substrate 10 and the periphery of the second substrate 11. The discharge space 12 is a space surrounded by the annular sealing member 70, the first substrate 10, and the second substrate 11.

The sealing member 70 may be formed of a frit composed mainly of $Bi_2O_3$ or $V_2O_5$. The frit composed mainly of $Bi_2O_3$ may be a mixture of a $Bi_2O_3$—$B_2O_3$—RO-MO glass material (where R denotes one of Ba, Sr, Ca, and Mg, and M denotes one of Cu, Sb, and Fe) and an oxide filler, such as $Al_2O_3$, $SiO_2$, or cordierite. The frit composed mainly of $V_2O_5$ may be a mixture of a $V_2O_5$—BaO—TeO—WO glass material and an oxide filler, such as $Al_2O_3$, $SiO_2$, or cordierite.

1-8. Tip Tube

The tip tube 81 is used to exhaust gases from the discharge space 12 and to introduce a discharge gas into the discharge space 12. After the discharge gas is introduced, the tip tube 81 is sealed by heating in order to prevent leakage of the discharge gas. The tip tube 81 may be a glass tube.

The tip tube 81 is joined to the first substrate 10 or the second substrate 11 with a sealing member 82. The first substrate 10 or the second substrate 11 has a through-hole 80 for coupling with the tip tube 81. A discharge gas can be introduced into the discharge space 12 through the through-hole 80 and the tip tube 81 and can be exhausted from the discharge space 12 through the through-hole 80 and the tip tube 81. The sealing member 82 may be formed of the same material as the sealing member 70.

The ultraviolet light emitting device 1 may have two or more through-holes 80 and two or more tip tubes 81. For example, each of the through-holes 80 and each of the tip tubes 81 may be used for intake and exhaust.

2. Operation

The operation of the ultraviolet light emitting device 1 according to the present embodiment will be described below.

In the electrodes 20, rectangular wave or sine wave voltages of opposite phases are applied to a pair of first electrode 21 and second electrode 22. More specifically, the phase of the voltage applied to the first electrode 21 is opposite to the phase of the voltage applied to the second electrode 22. This causes a very high electric field between the first electrodes 21 and the second electrodes 22 and induces electrical discharge in the discharge gas contained in the discharge space 12. FIG. 1 schematically illustrates the electrical discharge 90 in the discharge space 12.

Xe or KrCl in the discharge gas generates excitation light, such as vacuum ultraviolet light or deep ultraviolet light, due to excitation by electrical discharge. Upon irradiation with the excitation light, the light-emitting layer 40 emits deep ultraviolet light.

At least one of the first substrate 10 and the second substrate 11 is formed of a material that is transparent to ultraviolet light. In the present embodiment, the second substrate 11 is formed of sapphire glass, which is transparent to deep ultraviolet light. Thus, deep ultraviolet light from the light-emitting layer 40 is emitted outside the device from the second substrate 11. In other words, as illustrated in FIG. 1, the ultraviolet light emitting device 1 emits the ultraviolet light 91 outside the device.

3. Production Method 3-1. Outline

A method for producing the ultraviolet light emitting device 1 according to the present embodiment will be described below.

First, the electrodes 20 are formed on the first substrate 10. The electrodes 20 are formed by patterning a metal film by a known method, such as an exposure process, a printing process, or a vapor deposition process.

A dielectric paste is then applied, for example, by die coating to the main surface of the first substrate 10 in such a manner as to cover the electrodes 20 on the main surface of the first substrate 10, thereby forming a dielectric paste (dielectric material) layer. The dielectric paste is a paste of a dielectric material, for example, a coating liquid containing a dielectric material, such as a glass powder, a binder, and a solvent.

The dielectric paste layer is left to stand for a predetermined time for leveling, thus forming a flat surface. The dielectric paste layer is then baked and solidified to form the dielectric layer 30 covering the electrodes 20.

The protective layer 50 is then formed on the dielectric layer 30. The protective layer 50 may be formed from a pellet of MgO, CaO, SrO, BaO, or a mixture thereof by a thin film forming method. The thin film forming method may be a known method, such as an electron-beam evaporation method, a sputtering method, or an ion plating method. The practical upper pressure limit may be 1 Pa in a sputtering method and 0.1 Pa in an electron-beam evaporation method, which is one of evaporation methods.

The protective layer 50 may be omitted.

The light-emitting layer 40 is then formed on the protective layer 50. When the protective layer 50 is omitted, the light-emitting layer 40 is formed on the dielectric layer 30. The light-emitting layer 40 is formed by applying a paste containing a light-emitting material to a predetermined region and drying and baking the paste. The light-emitting material may contain a halogen atom and powdered magnesium oxide.

The amount of paste applied is different in the first regions 92 not directly above the electrodes 20 and the second regions 93 directly above the electrodes 20. More specifically, the amount of paste applied is greater in the first regions 92 than in the second regions 93.

For example, the paste is applied to (for example, the entire surface of) the first regions 92 and the second regions 93 on the dielectric layer 30 (or the protective layer 50) to the thickness of the second light-emitting portions 42 (for example, less than 10 μm) and is dried. The paste is then applied only to the first regions 92 to the thickness corresponding to the difference in thickness between the first light-emitting portions 41 and the second light-emitting portions 42 (for example, 20 μm) and is dried. The paste is then baked and forms the light-emitting layer 40 having an uneven surface, as illustrated in FIG. 1. The paste can be applied only to the first regions 92 by using a screen mask that allows the paste to be applied only to the first regions 92.

In the same manner as in the light-emitting layer 40, the light-emitting layer 60 is formed on the second substrate 11. The light-emitting layer 60 may have a uniform thickness. The light-emitting layer 60 may have a thickness smaller than the thickness of the first light-emitting portions 41 of the light-emitting layer 40. This can reduce the amount of ultraviolet light absorbed by the light-emitting layer 60 relative to the amount of ultraviolet light emitted from the light-emitting layer 40.

A sealing material is then applied to at least one of the first substrate 10 and the second substrate 11. In the present embodiment, the sealing material is circularly applied to the periphery of the first substrate 10. The sealing material may be a frit paste. The sealing material is then calcined at a temperature of approximately 350° C. in order to remove the resin component(s) of the sealing material. Thus, the calcined sealing member 70 is formed.

The first substrate 10 and the second substrate 11 are then joined together. A functional furnace used in a sealing step will be described below with reference to FIG. 3.

3-2. Functional Furnace

Figure 3:
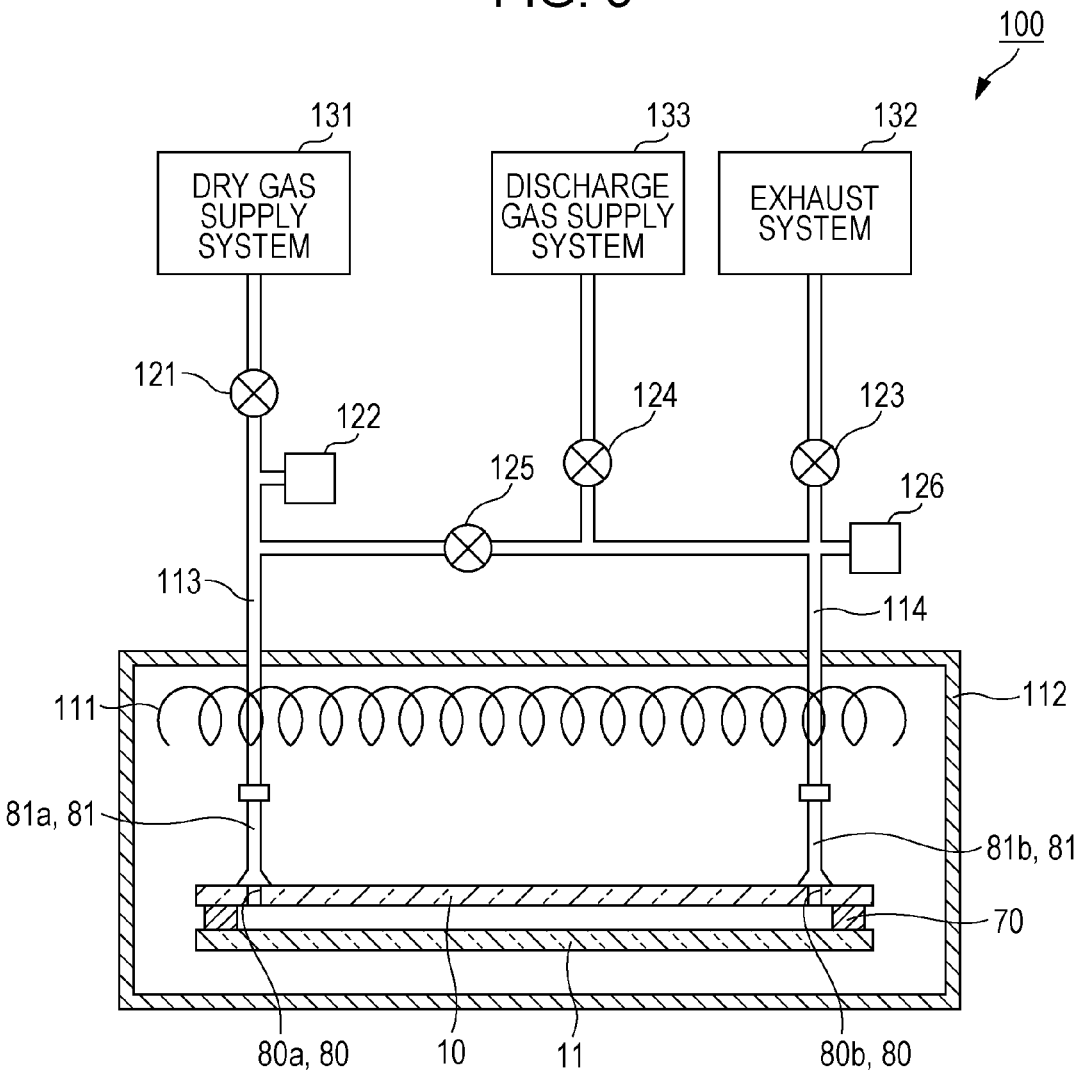
FIG. 3 is a schematic view of a functional furnace used in the production of the ultraviolet light emitting device according to the first embodiment.

FIG. 3 is a schematic view of a functional furnace 100 used in the production of the ultraviolet light emitting device 1 according to the present embodiment.

The functional furnace 100 is used in the sealing step. The functional furnace 100 can supply and exhaust a gas in the sealing step.

As illustrated in FIG. 3, the functional furnace 100 includes a furnace 112 including an internal heater 111. In the furnace 112, the first substrate 10 is disposed vertically upward from the second substrate 11. The first substrate 10 is provided with the calcined sealing member 70 and tip tubes 81*a* and 81*b*. The first substrate 10 and the second substrate 11 are fixed with fixing means (not shown), such as clips. Likewise, the first substrate 10 and the tip tubes 81*a* and 81*b* are fixed with fixing means (not shown). The tip tubes 81*a* and 81*b* communicate with the discharge space 12 via through-holes 80*a* and 80*b* bored in the first substrate 10.

As illustrated in FIG. 3, the tip tube 81*a* is coupled to piping 113. The piping 113 is coupled to a dry gas supply system 131 outside the furnace 112 through a valve 121. The piping 113 is provided with a gas relief valve 122.

The tip tube 81*b* is coupled to piping 114. The piping 114 is coupled to an exhaust system 132 outside the furnace 112 through a valve 123. The piping 114 is coupled to a discharge gas supply system 133 outside the furnace 112 through a valve 124. The piping 114 is also coupled to the piping 113 through a valve 125. The piping 114 is equipped with a pressure gauge 126.

3-3. Sealing Step

The sealing step will be described below with reference to FIGS. 4 and 5.

Figure 4:
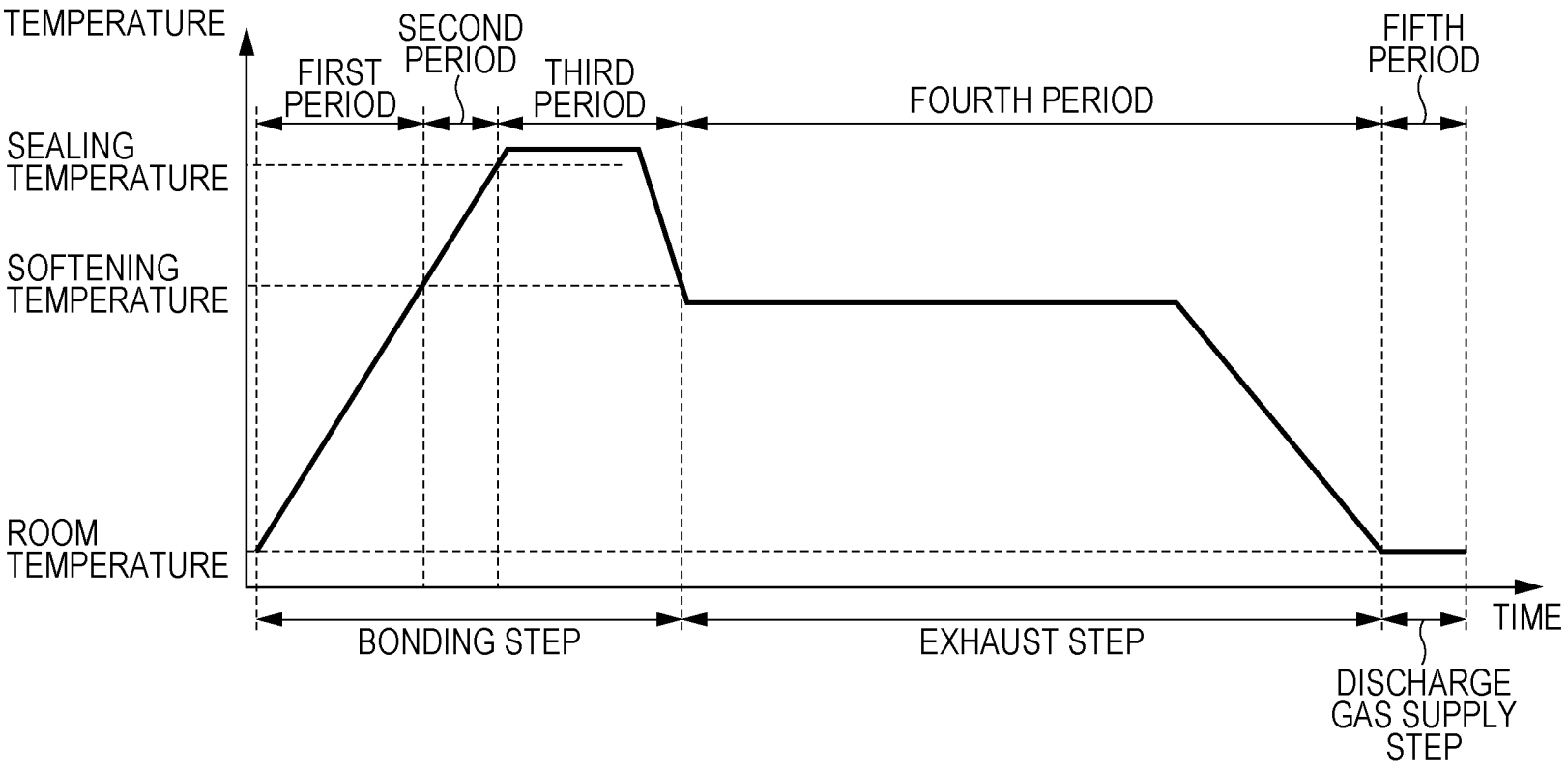
FIG. 4 is a temperature profile of the functional furnace according to the first embodiment.

FIG. 4 is a temperature profile of the functional furnace 100 according to the present embodiment. FIG. 5 is a schematic view of gas and gas flows in the sealing step according to the present embodiment.

The sealing step includes a bonding step, an exhaust step, and a discharge gas supply step. For convenience of explanation, as illustrated in FIG. 4, the sealing step is divided into five periods (first to fifth periods) on the basis of the temperature of the functional furnace 100.

In the first period, the temperature of the functional furnace 100 is increased from room temperature to the softening point (softening temperature). In the second period, the temperature of the functional furnace 100 is increased from the softening point to the sealing temperature. In the third period, the temperature of the functional furnace 100 is maintained at a temperature equal to or higher than the sealing temperature for a predetermined period and is then decreased to the softening point. The first to third periods correspond to the bonding step. In the fourth period, the temperature of the functional furnace 100 is maintained at a temperature close to or lower than the softening temperature for a predetermined period and is then decreased to room temperature. The fourth period corresponds to the exhaust step. In the fifth period, the temperature of the functional furnace 100 is maintained at room temperature. The fifth period corresponds to the discharge gas supply step.

The softening point refers to a temperature at which the sealing material softens. For example, $Bi_2O_3$ sealing materials have a softening temperature of approximately 430° C.

The sealing temperature refers to a temperature at which the first substrate 10 and the second substrate 11 are joined together with the sealing material and a temperature at which the first substrate 10 and the tip tubes 81 are joined together with the sealing material. For example, the sealing temperature in the present embodiment is approximately 490° C. The sealing temperature may be determined in advance as described below.

For example, while the first substrate 10 is disposed vertically upward from the second substrate 11, the valves 121, 124, and 125 are closed, and only the valve 123 is opened. While the gas is exhausted from the device (the discharge space 12) with the exhaust system 132 through the tip tube 81*b*, the furnace 112 is heated with the heater 111. At a certain temperature, the internal pressure of the device measured with the pressure gauge 126 decreases stepwise and does not increase significantly even after the valve 123 is closed. This temperature is the sealing temperature at which the device is sealed.

The sealing step will be described in detail below with reference to FIG. 5. In FIG. 5, (a) to (e) illustrate the gas in the device (the discharge space 12) and the gas flow in the first to fifth periods illustrated in FIG. 4.

<Bonding Step>

First, the first substrate 10 is appropriately placed vertically upward from the second substrate 11. As illustrated in FIG. 5(*a*), while the valve 121 and the valve 125 are opened, a dry gas 190 is introduced into the device through the through-holes 80*a* and 80*b*, and the furnace 112 is heated to the softening temperature of the sealing member 70 with the heater 111 (the first period).

Figure 5:
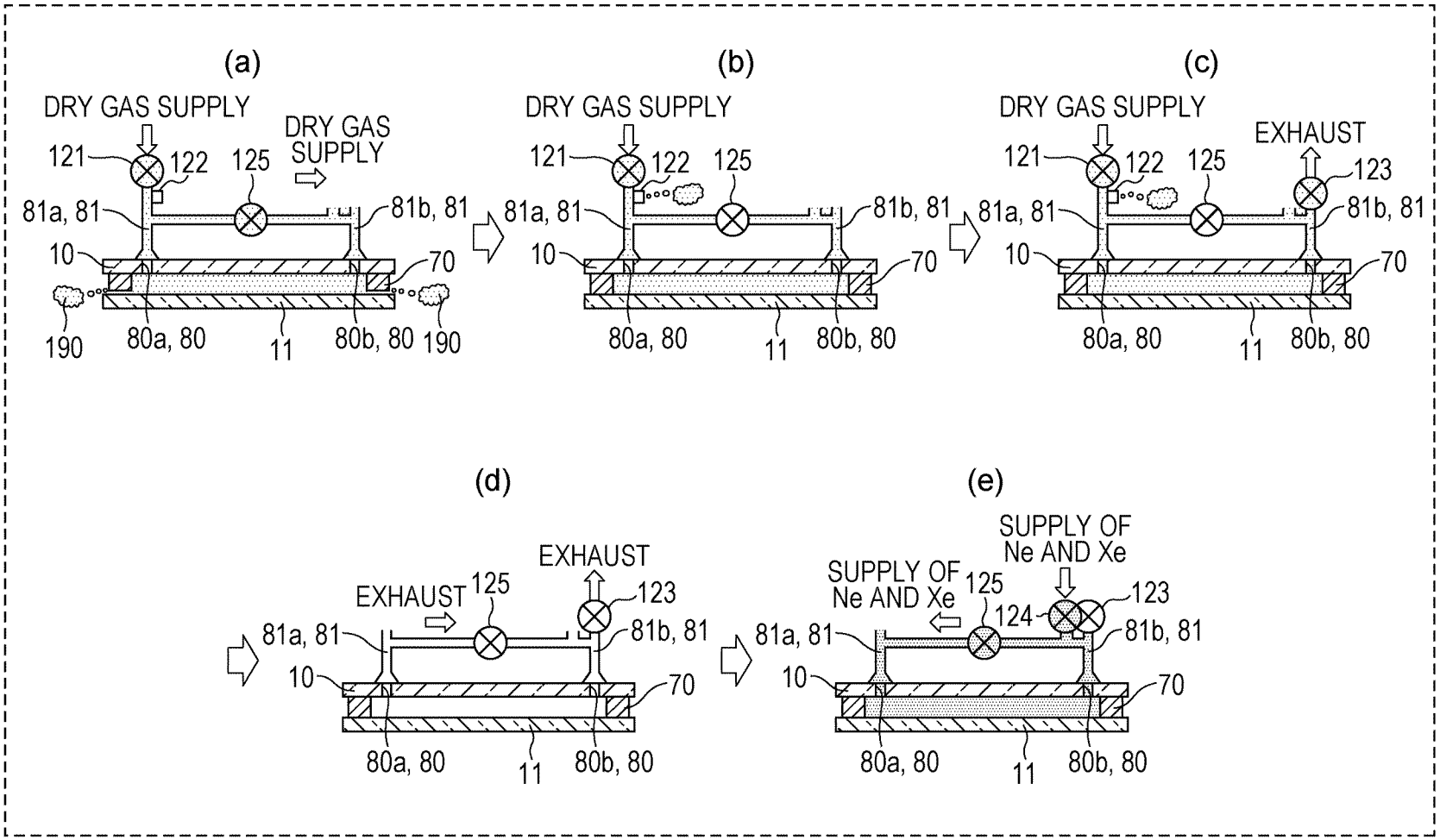
FIG. 5 is a schematic view of gas and gas flows in a sealing step according to the first embodiment.

As illustrated in FIG. 5(*a*), the dry gas 190 leaks from the device through a gap between the second substrate 11 and the sealing member 70.

The dry gas may be a dry nitrogen gas having a dew point of −45° C. or less. The flow rate of the dry gas may be 5 L/min.

When the internal temperature of the furnace 112 reaches or exceeds the softening temperature of sealing frit, as illustrated in FIG. 5(*b*), the valve 125 is closed, and the flow rate of a dry nitrogen gas is decreased with the valve 121 to less than or equal to the half (for example, 2 L /min) of the flow rate employed in the first period. The gas relief valve 122 is then opened so that the internal pressure of the device can be slightly higher than the internal pressure of the furnace 112. The internal temperature of the furnace 112 is then increased to the sealing temperature (the second period).

When the internal temperature of the furnace 112 reaches or exceeds the sealing temperature, the sealing member 70 melts and joins the first substrate 10 to the second substrate 11 and the first substrate 10 to the tip tubes 81. As illustrated in FIG. 5(*c*), the internal pressure of the device is made slightly negative (for example, $8.0\times10^4$ Pa) with the exhaust system 132 through the valve 123. Thus, the dry nitrogen gas is introduced through the tip tube 81*a* and is exhausted through the tip tube 81*b*, thereby flowing continuously through the device while the internal pressure of the device is maintained at a slightly negative pressure.

The internal temperature of the furnace 112 is maintained at a temperature equal to or higher than the sealing temperature for approximately 30 minutes with the heater 111. During this period, the molten sealing member 70 flows slightly, and the internal pressure of the device is maintained at a slightly negative pressure. Thus, the first substrate 10 and the second substrate 11 are sealed, and the first substrate 10 and the tip tubes 81 are precisely joined together. The heater 111 is then turned off to decrease the temperature of the furnace 112 to or below the softening point (the third period).

<Exhaust Step>

In the exhaust step, the gas is exhausted from the device. As illustrated in FIG. 5(*d*), when the internal temperature of the furnace 112 decreased to or below the softening temperature, the valve 121 is closed, the valve 123 and the valve 125 are opened, and the gas is exhausted from the device through the through-holes 80 and the tip tubes 81. The gas is continuously exhausted from the device while the internal temperature of the furnace 112 is maintained for a predetermined time with the heater 111. The heater 111 is then turned off to decrease the internal temperature of the furnace 112 to room temperature. During this period, the gas is continuously exhausted from the device (the fourth period).

<Discharge Gas Supply Step>

In the discharge gas supply step, a discharge gas, for example, composed mainly of Ne and Xe is supplied to the evacuated device. After the internal temperature of the furnace 112 is decreased to room temperature, as illustrated in FIG. 5(*e*), the valve 123 is closed, and the valve 124 and the valve 125 are opened to supply the discharge space 12 with the discharge gas at a predetermined pressure through the tip tubes 81 and the through-holes 80 (the fifth period).

The ultraviolet light emitting device 1 according to the present embodiment can be produced through these steps.

4. Advantages

The characteristics and advantages of the ultraviolet light emitting device 1 according to the present embodiment will be described below.

As described above, ultraviolet light emitting devices that include a light-emitting layer directly above electrodes have the problem that emission intensity decreases over time during continuous emission. The present inventors found that the problem results from two concurrent factors: a decreased emission intensity of the light-emitting layer directly above the electrodes due to ion bombardment caused by electrical discharge and a decreased emission intensity due to a change in the secondary electron emission characteristics of the light-emitting layer directly above the electrodes.

In order to solve the problem, the ultraviolet light emitting device 1 according to the present embodiment includes the first substrate 10, the electrodes 20 located on the main surface of the first substrate 10, the dielectric layer 30 that is located on the main surface of the first substrate 10 and covers the electrodes 20, the light-emitting layer 40 that is located on the dielectric layer 30 and emits ultraviolet light, and the second substrate 11 facing the light-emitting layer 40. The light-emitting layer 40 is thinner in the second regions 93 directly above the electrodes 20 than in the first regions 92 not directly above the electrodes 20. The discharge space 12 between the first substrate 10 and the second substrate 11 is filled with a predetermined gas. The light-emitting layer 40 emits ultraviolet light in the gas due to electrical discharge between the electrodes 20.

Since the light-emitting layer 40 is thinner in the second regions 93 directly above the electrodes 20, this can decrease the ratio of the emission intensity in the second regions 93 to the emission intensity of the entire ultraviolet light emitting device 1. Thus, even if the emission intensity of the light-emitting layer 40 in the second regions 93 decreases over time, the emission intensity of the entire ultraviolet light emitting device 1 can be less influenced. This can suppress the time-dependent decrease in the emission intensity of ultraviolet light from the ultraviolet light emitting device 1.

Furthermore, because the light-emitting layer 40 is thinner in the second regions 93, this decreases the coverage of the dielectric layer 30 or the protective layer 50. Thus, the initial discharge voltage is more influenced by the secondary electron emission characteristics of the dielectric layer 30 or the protective layer 50 under the light-emitting layer 40. The secondary electron emission characteristics change less in the dielectric layer 30 or the protective layer 50 than in the light-emitting layer 40. This can reduce a change in the secondary electron emission characteristics and suppress the decrease in discharge intensity during continuous emission.

In the present embodiment, the light-emitting layer 40 in the second regions 93 directly above the electrodes 20 is thinner and is more influenced by the secondary electron emission characteristics of the layer under the light-emitting layer 40. Thus, as illustrated in FIG. 1, the protective layer 50 under the light-emitting layer 40 is very effective. The protective layer 50 is preferably formed of a material having good secondary electron emission characteristics and high ion bombardment resistance. For example, a MgO thin film has stable high ion bombardment resistance and can provide an ultraviolet light emitting device that has a very small time-dependent change in discharge intensity and high emission intensity.

Figure 6:
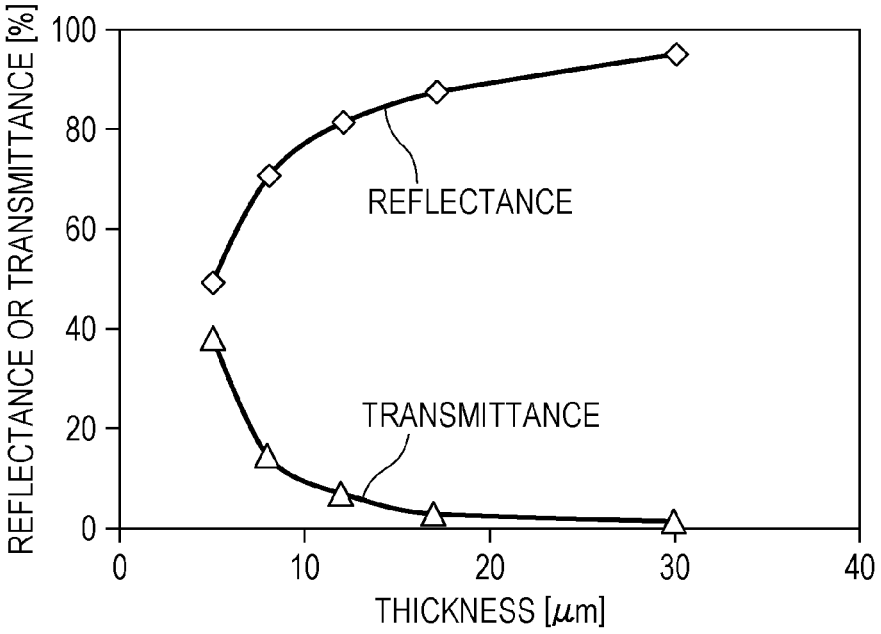
FIG. 6 is a graph of reflectance and transmittance as a function of the thickness of a light-emitting layer formed from powdered MgO.

It is desirable that the light-emitting layer 40 in the second regions 93 have a thickness of less than 10 μm when the light-emitting layer 40 is formed from a powder of a light-emitting material. FIG. 6 is a graph of transmittance and reflectance as a function of the thickness of the light-emitting layer 40 formed from powdered MgO.

FIG. 6 shows that transmittance increases rapidly at a film thickness of less than 10 μm. Thus, when the light-emitting layer 40 has a thickness of 10 μm or less, part of ultraviolet light emitted from a surface of the light-emitting layer 40 is transmitted to the side of the electrodes 20 and is absorbed by the dielectric layer 30. This can decrease the ratio of the emission intensity in the second regions 93 to the intensity of ultraviolet light emitted from the ultraviolet light emitting device 1.

When the light-emitting layer 40 in the second regions 93 becomes thinner, more ultraviolet light from the light-emitting layer 40 is transmitted to the side of the electrodes 20, and the emission intensity tends to decrease. Thus, when the light-emitting layer 40 in the second regions 93 becomes thinner, the time-dependent decrease in emission intensity is more suppressed, but the emission intensity itself decreases.

Figure 7:
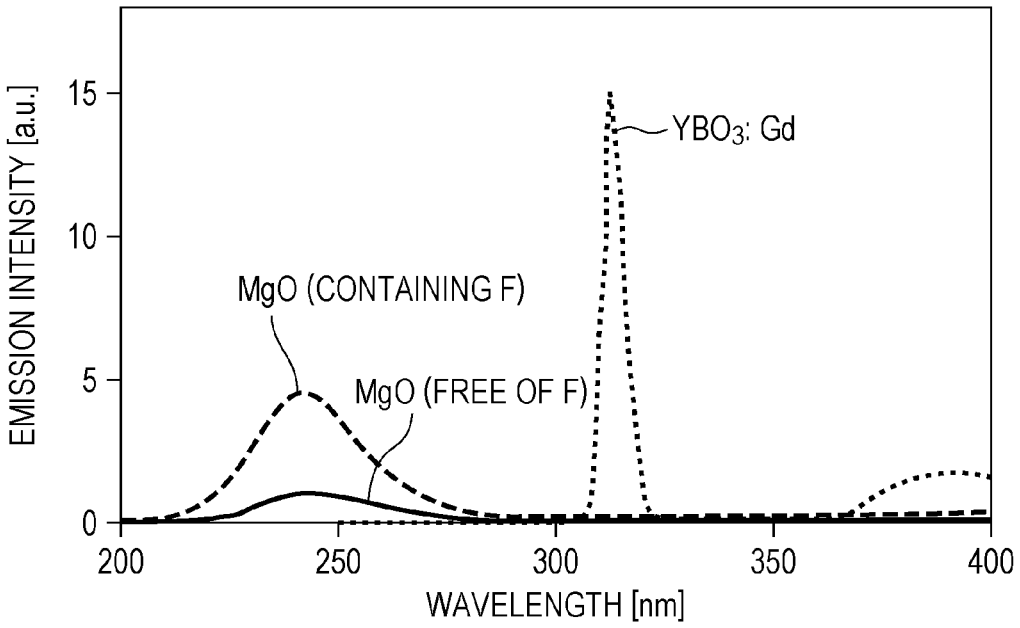
FIG. 7 is a graph of the emission intensity of light-emitting materials for a light-emitting layer.

FIG. 7 shows the emission spectrum of a phosphor material $YBO_3$:Gd doped with a rare-earth luminescent center and the emission spectra of powdered MgO that emits light of approximately 230 nm.

As illustrated in FIG. 7, powdered MgO (hereinafter referred to as a "MgO powder") emits deep ultraviolet light having a peak at approximately 230 nm and can therefore be used as a material of the light-emitting layer 40. Because MgO is a material having good secondary electron emission characteristics, MgO in the light-emitting layer 40 can achieve a lower initial discharge voltage than phosphor materials doped with a rare-earth luminescent center. Furthermore, MgO has high ion bombardment resistance and can suppress the degradation of the light-emitting layer 40 due to ion bombardment. Thus, in the ultraviolet light emitting device 1, it is probably very effective to use a MgO powder in the light-emitting layer 40.

However, the present inventors found another problem that a light-emitting layer formed from a MgO powder has a much larger decrease in discharge intensity during continuous emission than general phosphors that emit ultraviolet light. This is probably because MgO powders have better secondary electron emission characteristics than general phosphors that emit ultraviolet light, and therefore even slight degradation of the MgO powders during continuous emission results in a large deterioration in secondary electron emission characteristics. Thus, continuous emission increases the difference in secondary electron emission characteristics between a non-degradation region and a degradation region and greatly decreases emission intensity.

Thus, when a MgO powder is used, it is particularly effective to decrease the thickness of the light-emitting layer 40 in the second regions 93 that is directly above the electrodes 20 and is susceptible to ion bombardment, as in the ultraviolet light emitting device 1 according to the present embodiment.

The addition of fluorine to MgO powders can decrease the initial discharge voltage. When a MgO powder contains fluorine as a halogen atom, ion bombardment caused by electrical discharge moves fluorine from the light-emitting layer 40 to the protective layer 50. This enhances the secondary electron emission characteristics of the protective layer 50 over time and can suppress the decrease in discharge intensity. Thus, as illustrated in FIG. 7, the addition of fluorine to a MgO powder as a halogen atom can increase the emission intensity of the light-emitting layer 40.

A halogen atom in a MgO powder (the light-emitting layer 40) or a halogen atom in the protective layer 50 moved from a MgO powder (the light-emitting layer 40) can be analyzed by X-ray photoelectron spectroscopy (XPS) or inductively coupled plasma (ICP) emission spectrometry.

The gas to be filled in the discharge space 12 may be Ne, KrCl, $N_2$, CO, or Xe, as described above. When a MgO powder is used in the light-emitting layer 40, a gas mixture of Ne and Xe is suitable. MgO powders have a wide band gap and most efficiently emit light in response to excitation light of approximately 150 nm. When the discharge gas is KrCl or Xe alone, a large proportion of excitation light has a wavelength of more than 172 nm. When the discharge gas is a gas mixture of Ne and Xe, a large proportion of excitation light has a wavelength of 147 nm, and the MgO powder is effectively excited.

In the light-emitting layer 40 formed from a powdered material, the adhesiveness of a film of the powdered material is a major concern. Thus, a surface on which the light-emitting layer 40 is to be formed (for example, a top surface of the protective layer 50) may be roughened so that the powder material of the light-emitting layer 40 can be easily retained to form a film. Roughening can improve the adhesion between the light-emitting layer 40 and the protective layer 50. This is also true for the light-emitting layer 60. For example, roughening the main surface of the second substrate 11 (facing the discharge space 12) can improve the adhesion between the light-emitting layer 60 and the second substrate 11.

5. Modified Example

Figure 8:
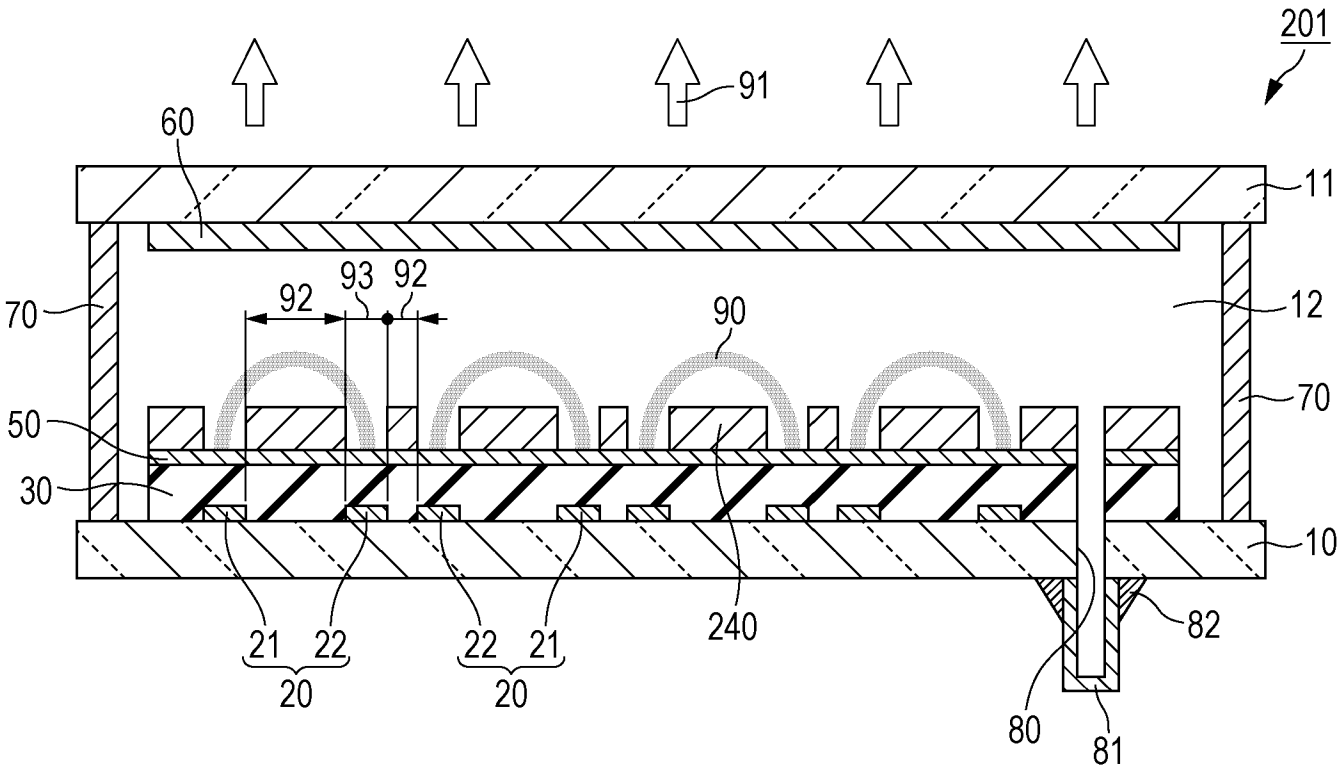
FIG. 8 is a cross-sectional view of an ultraviolet light emitting device according to a modified example of the first embodiment.

A modified example of the ultraviolet light emitting device 1 according to the present embodiment will be described below with reference to FIG. 8. FIG. 8 is a schematic cross-sectional view of an ultraviolet light emitting device 201 according to the present modified example.

The ultraviolet light emitting device 201 is different from the ultraviolet light emitting device 1 illustrated in FIG. 1 in that the ultraviolet light emitting device 201 includes a light-emitting layer 240 instead of the light-emitting layer 40. Except for this, the ultraviolet light emitting device 201 has the same structure as the ultraviolet light emitting device 1. As illustrated in FIG. 8, in the ultraviolet light emitting device 201, the light-emitting layer 240 in the second regions 93 has a thickness of zero. In other words, no light-emitting layer 240 is located directly above the electrodes 20.

In the present modified example, in the second regions 93 directly above the electrodes 20, the protective layer 50 (the dielectric layer 30 in the absence of the protective layer 50) is the outermost surface facing the discharge space 12. Thus, the discharging characteristics depend on the secondary electron emission characteristics of the dielectric layer 30 or the protective layer 50. This can further decrease local variations in the secondary electron emission characteristics and significantly reduce the decrease in discharge intensity during continuous emission.

A plausible reason why the dielectric layer 30 and the protective layer 50 have smaller variations in the secondary electron emission characteristics than the light-emitting layer 240 is described below. The light-emitting layer 240 is an aggregate of particles and has a very large specific surface area. Thus, ion bombardment caused by electrical discharge produces a large amount of impurity gas from the light-emitting layer 240, and the impurity gas accelerates degradation of the light-emitting layer 240 due to ion bombardment.

6. Examples

Examples of the ultraviolet light emitting devices 1 and 201 according to the embodiment and its modification and comparative examples were prepared, and their characteristics were compared.

The structure of the electrodes of these ultraviolet light emitting devices is illustrated in FIG. 2. Two comb-like electrodes constituted an interdigitated structure. The electrodes 20 were formed from Ag by resistance-heating evaporation. The distance between adjacent pair of first electrode 21 and second electrode 22 was 1 mm. Each of the first electrodes 21 and the second electrodes 22 had a width of 1 mm.

The first substrate 10 was formed of a commercially available high-strain-point glass, and the second substrate 11 was formed of sapphire glass, which is transparent to deep ultraviolet light. The light-emitting layer 60 was located on the main surface of the second substrate 11 (facing the discharge space 12). One side (an outer main surface) of the sapphire glass was polished, and the other main surface of the light-emitting layer 60 facing the discharge space 12 was unpolished. This improved the adhesion of the light-emitting layer 60.

The discharge space 12 was filled with a discharge gas composed of a gas mixture of Ne (95%) and Xe (5%) at 20 kPa.

The characteristics of the ultraviolet light emitting device measured included the emission intensity and initial discharge voltage immediately after the production and the emission intensity after continuous emission. The deterioration rate was calculated from the emission intensity immediately after the production and the emission intensity after continuous emission. The deterioration rate is the ratio of the emission intensity after continuous emission to the emission intensity immediately after the production.

An alternating voltage of a 30-kHz rectangular wave was applied to the electrodes 20. Rectangular wave voltages of opposite phases were applied to the first electrodes 21 and the second electrodes 22. More specifically, the phase of the voltage applied to the first electrodes 21 was opposite to the phase of the voltage applied to the second electrodes 22. The continuous emission time was 1000 hours.

The initial discharge voltage was measured as follows: first, the rectangular wave voltage applied to the electrodes was increased to 950 V, thereby allowing the ultraviolet light emitting device to emit light. The rectangular wave voltage was then decreased to 0 V to interrupt the light emission from the entire device. The rectangular wave voltage was then increased, and the voltage at which electrical discharge spread over the discharge space 12 was measured as the initial discharge voltage.

The emission intensity is a relative value based on the emission intensity of an ultraviolet light emitting device including a light-emitting layer having a uniform thickness. The emission intensity on the outermost surface of a structure (the second substrate 11) of an ultraviolet light emitting device that is transparent to ultraviolet light was measured with a photonic multichannel analyzer (C10027-01 manufactured by Hamamatsu Photonics K.K.) and was digitized by integration in the emission wavelength region. For example, for a light-emitting layer formed from a MgO powder, which has an emission peak at approximately 230 nm, the emission intensity was integrated over the range of 200 to 280 nm. The relative value is based on the emission intensity of a ultraviolet light emitting device according to Comparative Example 1 measured immediately after the production thereof, which is taken as 100.

After the initial discharge voltage was measured, light emission from the ultraviolet light emitting device was continued at a measuring voltage for 1000 hours, and the emission intensity after the continuous emission was measured. The initial emission intensity and the emission intensity after continuous emission were measured at the initial discharge voltage.

FIG. 9 is a table of the characteristic evaluation results for ultraviolet light emitting devices according to the present embodiment, modified examples thereof, and comparative examples.

Comparative Examples 1 and 2 were prepared as shown in FIG. 9. A MgO thin film having a thickness of 1 μm was formed as the protective layer 50 under the light-emitting layer 40 by vacuum evaporation.

The material of the light-emitting layer 40 and the light-emitting layer 60 was $YBO_3$:Gd in Comparative Example 1 and a MgO powder having a peak wavelength in the range of 200 to 300 nm in Comparative Example 2. The light-emitting layer 40 had a thickness of 30 μm, and the light-emitting layer 60 had a thickness of 5 μm. The MgO powder used for the light-emitting layer 40 and the light-emitting layer 60 contained fluorine as a halogen atom, which was identified by XPS.

Example 1 is an ultraviolet light emitting device according to the present embodiment and had the same structure as Comparative Example 1 except that the light-emitting layer 40 in the second regions 93 directly above the electrodes 20 had a thickness of 8 μm (the thickness of the second light-emitting portions 42).

Example 2 is an ultraviolet light emitting device according to the present embodiment and had the same structure as Comparative Example 2 except that the light-emitting layer 40 in the second regions 93 directly above the electrodes 20 had a thickness of 12 μm (the thickness of the second light-emitting portions 42).

Example 3 is an ultraviolet light emitting device according to the present embodiment and had the same structure as Comparative Example 2 except that the light-emitting layer 40 in the second regions 93 directly above the electrodes 20 had a thickness of 8 μm (the thickness of the second light-emitting portions 42).

Example 4 is an ultraviolet light emitting device according to a modified example of the present embodiment and had the same structure as Comparative Example 2 except that the light-emitting layer 240 in the second regions 93 directly above the electrodes 20 had a thickness of zero.

FIG. 9 shows that the thickness of the light-emitting layer 40 in the second regions 93 smaller than the thickness of the light-emitting layer 40 in the first regions 92 resulted in a significant improvement in deterioration rate. This is probably because the smaller thickness of the light-emitting layer 40 in the second regions 93 enhanced the influence of the secondary electron emission characteristics of the protective layer 50 under the light-emitting layer 40, thus reducing the change in the secondary electron emission characteristics and suppressing the decrease in discharge intensity. This is also probably because a lower ratio of the emission intensity in the second regions 93 to the emission intensity of the ultraviolet light emitting device 1 resulted in a smaller influence of the emission intensity in the second regions 93 on the emission intensity of the ultraviolet light emitting device 1.

FIG. 9 also shows that the initial emission intensity of the ultraviolet light emitting device 1 decreased with decreasing thickness of the light-emitting layer 40 in the second regions 93. However, the emission intensity after continuous emission tended to increase with decreasing thickness of the light-emitting layer 40 in the second regions 93.

A comparison of Comparative Example 2 and Example 2 shows that the deterioration rate was improved even when the light-emitting layer 40 in the second regions 93 had a thickness of 12 μm. Thus, the light-emitting layer 40 in the second regions 93 may have a thickness of 10 μm or more.

A comparison of Comparative Example 1 and Example 1 shows that the deterioration rate was also improved in the case that the material of the light-emitting layer 40 was $YBO_3$:Gd. Thus, the material of the light-emitting layer 40 is not limited to the powdered MgO.

Second Embodiment

1. Structure

Figure 10:
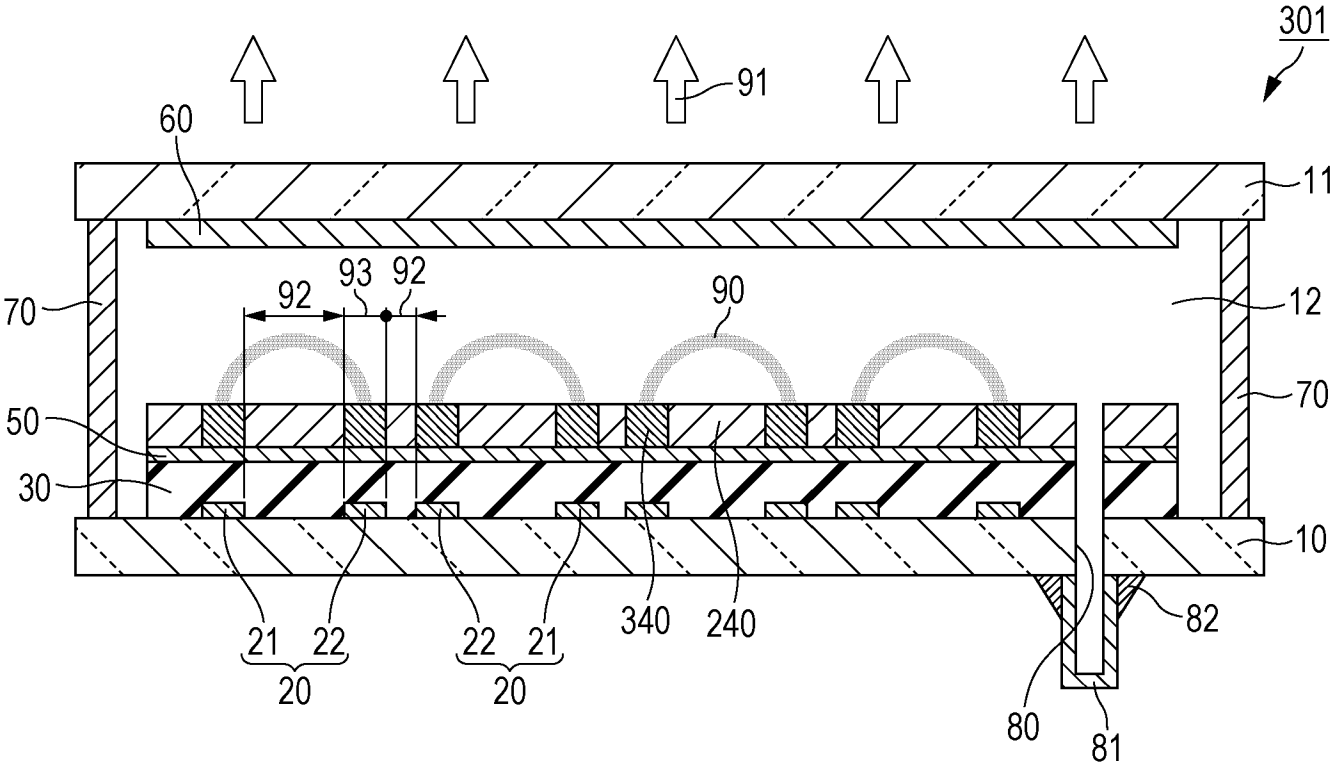
FIG. 10 is a schematic cross-sectional view of an ultraviolet light emitting device according to a second embodiment.

An ultraviolet light emitting device 301 according to a second embodiment of the present disclosure will be described below with reference to FIG. 10. FIG. 10 is a schematic cross-sectional view of the ultraviolet light emitting device 301 according to the present embodiment.

In the present embodiment, components same as or similar to the modified example of the first embodiment are denoted by the same reference numerals and may not be described in detail.

The ultraviolet light emitting device 301 according to the present embodiment differs from the ultraviolet light emitting device 201 according to the modified example of the first embodiment in that the ultraviolet light emitting device 301 further includes a light-emitting layer 340.

The ultraviolet light emitting device 301 includes two light-emitting layers and contains two light-emitting materials. More specifically, the ultraviolet light emitting device 301 includes the light-emitting layers 240 and 340. The light-emitting layer 240 contains a first light-emitting material, and the light-emitting layer 340 contains a second light-emitting material, which is different from the first light-emitting material. The first light-emitting material has a different emission spectrum from the second light-emitting material. More specifically, the deep ultraviolet emission intensity at approximately 230 nm is higher in the first light-emitting material than in the second light-emitting material.

The light-emitting layer 340 is located in the second regions 93 directly above the electrodes 20 and is an example of the second light-emitting layer that emits ultraviolet light. The light-emitting layer 340 contains a different type or amount of material from the light-emitting layer 240 and has a lower ultraviolet emission intensity than the light-emitting layer 240. In the present embodiment, the light-emitting layer 340 has almost the same thickness as the light-emitting layer 240.

The light-emitting layer 340 contains powdered magnesium oxide (a MgO powder) but no halogen atom. As described in the first embodiment, the light-emitting layer 240 contains the MgO powder and a halogen atom. The halogen atom may be fluorine. As illustrated in FIG. 7, therefore, the light-emitting layer 340 has a lower emission intensity than the light-emitting layer 240.

2. Production Method

A method for producing the ultraviolet light emitting device 301 according to the present embodiment will be described below. The method for producing the ultraviolet light emitting device 1 according to the first embodiment is performed except for the formation of the light-emitting layers 240 and 340. Thus, a method for forming the light-emitting layers 240 and 340 according to the present embodiment will be described below.

First, a paste containing a second light-emitting material having a low emission intensity is applied through a screen mask having a pattern applicable to the second regions 93 directly above the electrodes 20 (the planar shape of the electrodes 20) and is dried. A paste containing a first light-emitting material having a high emission intensity is then applied through a screen mask having a pattern applicable to the first regions 92 not directly above the electrodes 20 and is dried and baked.

The second light-emitting material may be applied after the first light-emitting material is applied.

3. Advantages

The characteristics and advantages of the ultraviolet light emitting device 301 according to the present embodiment will be described below.

The ultraviolet light emitting device 301 according to the present embodiment further includes the light-emitting layer 340 in the second regions 93. The light-emitting layer 340 contains a different type or amount of material from the light-emitting layer 240 and has a lower ultraviolet emission intensity than the light-emitting layer 240.

Thus, the time-dependent decrease in emission intensity can be suppressed while maintaining high emission intensity.

A plausible reason for this is as follows: MgO powders having weak deep ultraviolet emission at 230 nm have secondary electron emission characteristics inferior to those of MgO powders having strong deep ultraviolet emission at 230 nm Thus, when a MgO powder having weak deep ultraviolet emission at 230 nm is used for the light-emitting layer 340 in the second regions 93, this results in poor secondary electron emission characteristics before continuous emission and relatively small local variations, thus suppressing the time-dependent decrease in discharge intensity. This can also decrease the ratio of the emission intensity in the second regions 93 to the deep ultraviolet emission intensity of the entire ultraviolet light emitting device 301 and therefore suppress the time-dependent decrease in the emission intensity of the ultraviolet light emitting device 301.

Thus, the ultraviolet light emitting device 301 according to the present embodiment can achieve relatively small local variations in the secondary electron emission characteristics of the second regions 93 during continuous emission and decrease the emission intensity in the second regions 93. Thus, the time-dependent decrease in the emission intensity of the ultraviolet light emitting device 301 can be suppressed.

The light-emitting layers 240 and 340, which contain the MgO powder as a main component, have very high porosity and are therefore easily influenced by the secondary electron emission characteristics of the layer under the light-emitting layers 240 and 340. Thus, as in the first embodiment, it is very effective to provide the protective layer 50 formed of a material having good secondary electron emission characteristics and high ion bombardment resistance under the light-emitting layers 240 and 340.

4. Modified Example

A modified example of the ultraviolet light emitting device 301 according to the present embodiment will be described below. Although the light-emitting layer 340 in the present embodiment contains no halogen atom, the light-emitting layer 340 in the present modified example contains a halogen atom.

The number of halogen atoms in the MgO powder can be altered to change deep ultraviolet emission intensity. More specifically, the light-emitting layer 340 contains a smaller number of halogen atoms than the light-emitting layer 240. This can make the emission intensity of the light-emitting layer 340 in the second regions 93 directly above the electrodes 20 smaller than the emission intensity of the light-emitting layer 240 in the first regions 92 not directly above the electrodes 20. Thus, the number of halogen atoms (fluorine) can be changed to adjust the emission intensity of the light-emitting layer 340.

5. Examples

The ultraviolet light emitting device 301 according to the present embodiment was prepared, and the characteristics of the ultraviolet light emitting device 301 were compared as shown in FIG. 11. FIG. 11 is a table of the characteristic evaluation results for the ultraviolet light emitting devices according to the present embodiment and a comparative example.

Comparative Example 2 in FIG. 11 is the same as Comparative Example 2 in the first embodiment.

Example 5 is the ultraviolet light emitting device 301 according to the present embodiment. The material of the light-emitting layer 240 in the first regions 92 not directly above the electrodes 20 is different from the material of the light-emitting layer 340 in the second regions 93 directly above the electrodes 20. More specifically, the light-emitting layer 240 contains fluorine as a halogen atom, whereas the light-emitting layer 340 contains no fluorine. Thus, as shown in FIG. 11, the emission intensity of the light-emitting layer 340 in the second regions 93 is lower than the emission intensity of the light-emitting layer 240 in the first regions 92 by approximately 40%. Except for this, Example 5 has the same structure as Comparative Example 2.

FIG. 11 shows that lowering the emission intensity of the light-emitting layer 340 in the second regions 93 significantly improved the deterioration rate. This is probably because a lower ratio of the emission intensity in the second regions 93 to the emission intensity of the entire ultraviolet light emitting device 301 resulted in a smaller time-dependent decrease in the emission intensity of the ultraviolet light emitting device 301.

FIG. 11 also shows that lowering the emission intensity of the light-emitting layer 340 in the second regions 93 decreased the initial emission intensity of the ultraviolet light emitting device 301. However, the emission intensity after continuous emission in Example 5 was higher than that in Comparative Example 2 in which the emission intensity in the second regions 93 was the same as the emission intensity in the first regions 92.

Third Embodiment

1. Structure

Figure 12:
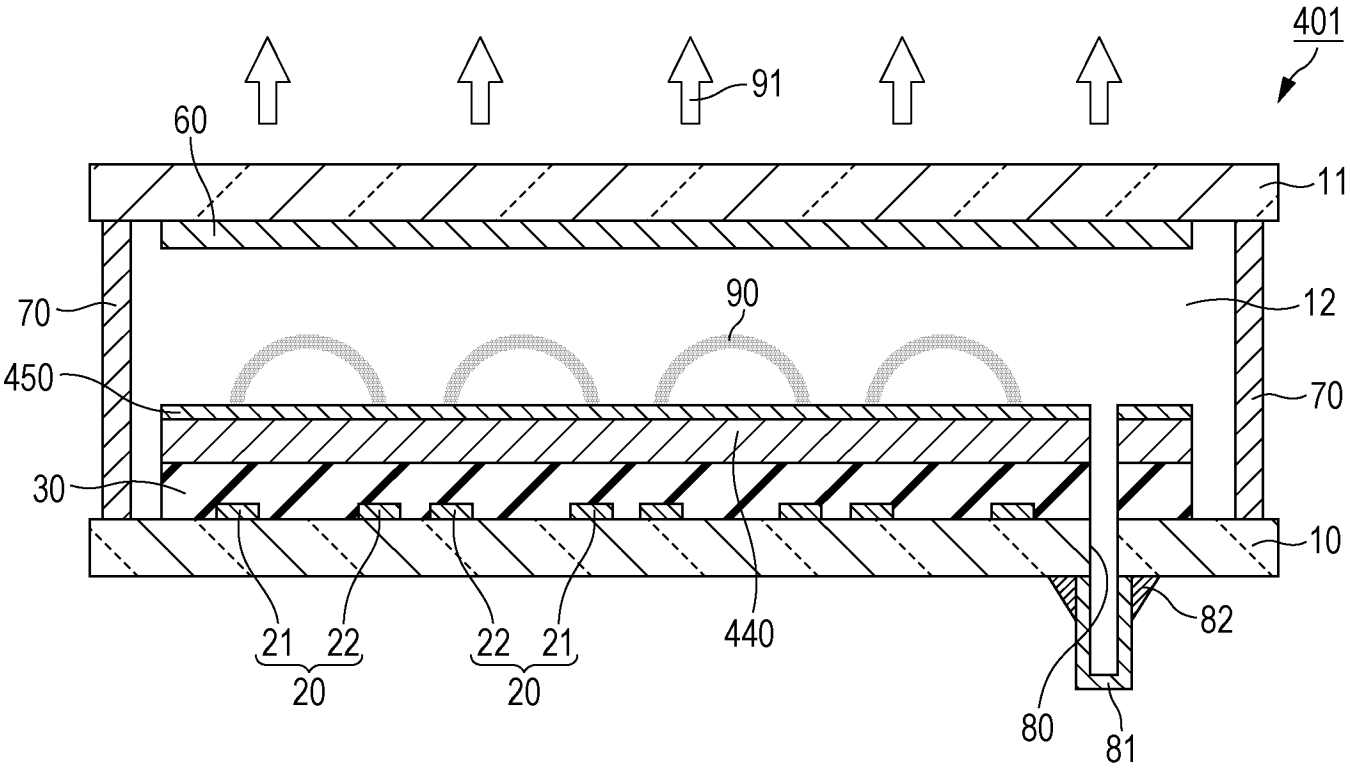
FIG. 12 is a schematic cross-sectional view of an ultraviolet light emitting device according to a third embodiment.

An ultraviolet light emitting device 401 according to a third embodiment of the present disclosure will be described below with reference to FIG. 12. FIG. 12 is a schematic cross-sectional view of the ultraviolet light emitting device 401 according to the present embodiment.

In the present embodiment, components same as or similar to the first embodiment are denoted by the same reference numerals and may not be described in detail.

The ultraviolet light emitting device 401 according to the present embodiment differs from the ultraviolet light emitting device 1 according to the first embodiment in that the ultraviolet light emitting device 401 includes a light-emitting layer 440 and a protective layer 450 instead of the light-emitting layer 40 and the protective layer 50.

The light-emitting layer 440 is located on the dielectric layer 30 and is an example of the first light-emitting layer that emits ultraviolet light. The light-emitting layer 440 is located between the dielectric layer 30 and the protective layer 450. In the present embodiment, the light-emitting layer 440 has a substantially uniform thickness in the first regions 92 not directly above the electrodes 20 and in the second regions 93 directly above the electrodes 20. The light-emitting layer 440 may have a thickness in the range of 20 to 30 μm.

The material in the light-emitting layer 440 may be the same as the material in the light-emitting layer 40 in the first embodiment. More specifically, the light-emitting layer 440 contains powdered magnesium oxide that emits ultraviolet light and a halogen atom. The halogen atom may be fluorine. The light-emitting layer 440 emits deep ultraviolet light having a peak wavelength in the range of 200 to 300 nm.

The protective layer 450 is a thin film located on the light-emitting layer 440. The protective layer 450 faces the second substrate 11. The protective layer 450 is exposed to the discharge space 12. The protective layer 450 is directly exposed to electrical discharge in the discharge space 12 and thereby protects the light-emitting layer 440 from the electrical discharge. More specifically, the protective layer 450 covers the light-emitting layer 440 such that the light-emitting layer 440 is not exposed to the discharge space 12. Thus, the protective layer 450 can prevent the light-emitting layer 440 from being directly exposed to electrical discharge generated in the discharge space 12.

The protective layer 450 is a thin film that contains at least one of magnesium oxide (MgO), calcium oxide (CaO), barium oxide (BaO), and strontium oxide (SrO). The protective layer 450 may be a mixed-phase thin film containing two or more of MgO, CaO, BaO, and SrO. For example, the protective layer 450 has a thickness of 1 μm.

2. Production Method

A method for producing the ultraviolet light emitting device 401 according to the present embodiment will be described below. The method for producing the ultraviolet light emitting device 1 according to the first embodiment is performed except for the formation of the light-emitting layer 440 and the protective layer 450. Thus, a method for forming the light-emitting layer 440 and the protective layer 450 according to the present embodiment will be described below.

A paste containing a light-emitting material is applied to a region (for example, the entire surface) on the dielectric layer 30 and is baked to form the light-emitting layer 440. The paste containing a light-emitting material may be applied in a substantially uniform thickness. The light-emitting material may contain a halogen atom and powdered magnesium oxide.

The protective layer 450 is then formed on the light-emitting layer 440. For example, the protective layer 450 is formed from a pellet of MgO, CaO, SrO, BaO, or a mixture thereof by a thin film forming method. The thin film forming method may be a known thin film forming method, such as an electron-beam evaporation method, a sputtering method, or an ion plating method.

3. Advantages

The characteristics and advantages of the ultraviolet light emitting device 401 according to the present embodiment will be described below.

The ultraviolet light emitting device 401 according to the present embodiment includes the first substrate 10, the electrodes 20 located on the main surface of the first substrate 10, the dielectric layer 30 that is located on the main surface of the first substrate 10 and covers the electrodes 20, the light-emitting layer 440 that is located on the dielectric layer 30 and emits ultraviolet light, the protective layer 450 that is located on the light-emitting layer 440 and contains at least one of magnesium oxide, calcium oxide, barium oxide, and strontium oxide, and the second substrate 11 facing the protective layer 450. The discharge space 12 between the first substrate 10 and the second substrate 11 is filled with a predetermined gas. The light-emitting layer 440 emits ultraviolet light in the gas due to electrical discharge between the electrodes 20.

The protective layer 450 on the light-emitting layer 440 can suppress the time-dependent decrease in the emission intensity of the ultraviolet light emitting device 401 during continuous emission.

A plausible reason for this is as follows: The protective layer 450 formed of a material having high ion bombardment resistance can protect the light-emitting layer 440 from ion bombardment caused by electrical discharge. Thus, the protective layer 450 can suppress the degradation of the light-emitting layer 440.

MgO, CaO, BaO, SrO, or a mixed-phase material thereof in the protective layer 450 has high light transmittance in a deep ultraviolet region. Thus, deep ultraviolet light from the light-emitting layer 440 is negligibly absorbed by the protective layer 450. This can suppress the decrease in the emission intensity of the ultraviolet light emitting device 401 and suppress the time-dependent decrease in the emission intensity of the ultraviolet light emitting device 401.

Furthermore, the protective layer 450 formed of a material having good secondary electron emission characteristics is directly exposed to the discharge space 12 and can therefore decrease the initial discharge voltage.

Thus, the protective layer 450 on the light-emitting layer 440 can suppress the time-dependent decrease in emission intensity and provide an ultraviolet light emitting device having high emission intensity.

Although the protective layer 450 is only formed on the light-emitting layer 440 in FIG. 12, another structure is also possible. For example, as in the first embodiment, the protective layer 50 may be located between the light-emitting layer 440 and the dielectric layer 30.

This can improve the secondary electron emission characteristics and further decrease the initial discharge voltage. This is because the light-emitting layer 440 is formed from powdered MgO, and the secondary electron emission characteristics that have an influence on electrical discharge is influenced not only by the layer on the light-emitting layer 440 but also by the layer under the light-emitting layer 440.

4. Examples

The ultraviolet light emitting device 401 according to the present embodiment was produced, and the characteristics of the ultraviolet light emitting device 401 were compared as shown in FIG. 13. FIG. 13 is a table of the characteristic evaluation results for the ultraviolet light emitting devices 401 according to the present embodiment and comparative examples.

Comparative Examples 1 and 2 in FIG. 13 are the same as Comparative Examples 1 and 2 in the first embodiment.

Each of Examples 6 and 7 is the ultraviolet light emitting device 401 according to the present embodiment and includes a MgO thin film as the protective layer 450 on the light-emitting layer 440. Except for this, Example 6 has the same structure as Comparative Example 1, and Example 7 has the same structure as Comparative Example 2. The protective layer 450 was a MgO thin film having a thickness of 1 μm formed on the light-emitting layer 440 by a sputtering method.

FIG. 13 shows that the protective layer 450 formed of the MgO thin film on the light-emitting layer 440 improved the deterioration rate. Because the MgO thin film having good secondary electron emission characteristics was exposed to the discharge space 12, the initial discharge voltage was decreased. Although the protective layer 450 was located on the light-emitting layer 440, the initial emission intensity was not significantly decreased.

Although MgO was used in the protective layer 450 in the present embodiment, CaO, BaO, SrO, or a mixed-phase layer thereof can also achieve good secondary electron emission characteristics. Thus, the time-dependent decrease in emission intensity during continuous emission can be suppressed.

Fourth Embodiment

1. Structure

Figure 14:
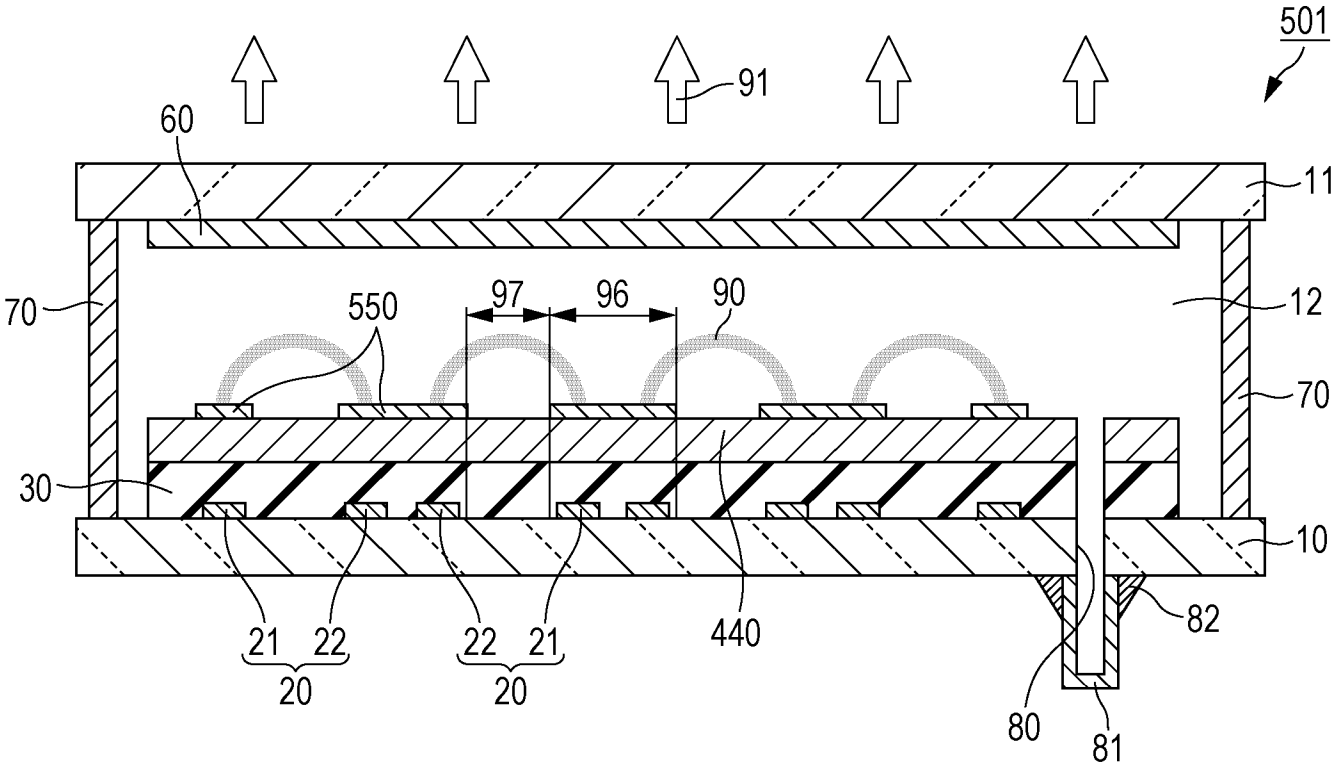
FIG. 14 is a schematic cross-sectional view of an ultraviolet light emitting device according to a fourth embodiment.

An ultraviolet light emitting device 501 according to a fourth embodiment of the present disclosure will be described below with reference to FIG. 14. FIG. 14 is a schematic cross-sectional view of the ultraviolet light emitting device 501 according to the present embodiment.

In the present embodiment, components same as or similar to the third embodiment are denoted by like reference numerals and may not be described in detail.

The ultraviolet light emitting device 501 according to the present embodiment differs from the ultraviolet light emitting device 401 according to the third embodiment in that the ultraviolet light emitting device 501 includes a protective layer 550 instead of the protective layer 450. As illustrated in FIG. 14, the ultraviolet light emitting device 501 includes the protective layer 550 in third regions 96 directly above the electrodes 20 but no protective layer 550 in fourth regions 97 not directly above the electrodes 20. It goes without saying that the third regions 96 are not necessarily identical to the planar shapes of the electrodes 20 in consideration of the production process. More specifically, the third regions 96 may be narrower or wider than the planar shapes of the electrodes 20. In other words, the third regions 96 include at least part of regions directly above the electrodes 20. The third regions 96 may be located not only directly above the electrodes 20 but also on regions including gaps between two adjacent electrodes 20. In particular, as illustrated in FIG. 14, if the third regions 96 include all the regions directly above the electrodes 20, this can enhance the advantages of the present embodiment. The fourth regions 97 are regions different from the third regions 96 on the light-emitting layer 440.

2. Production Method

A method for producing the ultraviolet light emitting device 501 according to the present embodiment will be described below. The protective layer 550 is formed with a screen mask having a pattern applicable to the third regions 96 including regions directly above the electrodes 20. For example, the protective layer 450 is formed from a pellet of MgO, CaO, SrO, BaO, or a mixture thereof by a thin film forming method. The thin film forming method may be a known thin film forming method, such as an electron-beam evaporation method, a sputtering method, or an ion plating method. The other steps are the same as or similar to those in the third embodiment.

3. Advantages

The characteristics and advantages of the ultraviolet light emitting device 501 according to the present embodiment will be described below. The ultraviolet light emitting device 501 according to the present embodiment includes the protective layer 550 in the third regions 96 directly above the electrodes 20 and therefore has advantages same as or similar to the third embodiment. Furthermore, the absence of the protective layer 550 in the fourth regions 97 not directly above the electrodes 20 can suppress the decrease in the emission intensity of the light-emitting layer due to the protective layer.

Other Embodiments

Although the ultraviolet light emitting devices according to one or two or more embodiments are described above, the present disclosure is not limited to these embodiments. Various modifications of these embodiments and combinations of constituents of different embodiments conceived by a person skilled in the art without departing from the gist of the present disclosure are also fall within the scope of the present disclosure.

For example, although the protective layer 50 under the light-emitting layer 40 was the MgO thin film in the first and second embodiments, the protective layer 50 is not limited to the MgO thin film. The protective layer 50 may be formed of CaO, BaO, SrO, or a mixed-phase layer thereof, instead of MgO. The protective layer 50 formed of one of these materials can also achieve good electron emission characteristics and suppress the time-dependent decrease in emission intensity during continuous emission.

Although the light-emitting layer 60 having a thickness of 5 μm was formed on the second substrate 11 in the first to third embodiments, the present disclosure is not limited to this. For example, the time-dependent decrease in emission intensity during continuous emission can be suppressed without the light-emitting layer 60 on the second substrate 11.

Although the MgO powder containing fluorine as a halogen atom was used as a material of the light-emitting layer in the first to third embodiments, a halogen atom other than fluorine, such as chlorine (Cl), may be used. Alternatively, the light-emitting layer may contain no halogen atoms. Also in such a case, as illustrated in FIG. 7, the MgO powder can emit ultraviolet light having a peak in the range of 200 to 300 nm.

Although the second substrate 11 in the first to third embodiments was formed of sapphire glass having a polished surface and had a rough surface on which the light-emitting layer 60 was formed, the present disclosure is not limited to this. For example, the second substrate 11 may have a rough surface formed by sandblasting.

Although the gas mixture of Ne and Xe was used as a discharge gas in the first to third embodiments, Xe may be used alone, or another gas, such as $F_2$, may be used.

Although the light-emitting layer 340 and no light-emitting layer 240 were located in the second regions 93 directly above the electrodes 20 in the second embodiment, the present disclosure is not limited to this. For example, a light-emitting layer containing the same material as the light-emitting layer 240 may be located under the light-emitting layer 340. The light-emitting layer 340 may be located on the second light-emitting portions 42 of the light-emitting layer 40 described in the first embodiment.

Although the first substrate 10 and the second substrate 11 were flat sheets, that is, the ultraviolet light emitting device was a panel in the first to third embodiments, the present disclosure is not limited to this. For example, each of the first substrate 10 and the second substrate 11 may be a curved sheet having a curved main surface. For example, each of the first substrate 10 and the second substrate 11 may be tubular. The inner diameter of the second substrate 11 may be greater than the outer diameter of the first substrate 10, and the first substrate 10 may be located within the second substrate 11. This allows ultraviolet light to be emitted in all directions from a side surface of the second substrate 11.

Various modifications, replacement, addition, and omission may be made to the embodiments within the scope and equivalents of the appended claims.

The present disclosure can provide an ultraviolet light emitting device having a small time-dependent decrease in emission intensity during continuous emission and can be applied to sterilization, water purification, lithography, and illumination.

What is claimed is:

1. An ultraviolet light emitting device comprising:

a first substrate having a main surface;

a second substrate facing the main surface of the first substrate;

a gas in a space between the first substrate and the second substrate;

electrodes directly or indirectly on the main surface of the first substrate;

a dielectric layer that is located directly or indirectly on the main surface of the first substrate and covers the electrodes; and a first light-emitting layer that is located directly or indirectly on the dielectric layer and emits ultraviolet light in the gas due to electrical discharge between the electrodes, wherein the first light-emitting layer has an uneven surface facing the second substrate due to being thicker in first regions on the dielectric layer than in second regions different from the first regions, the second regions including at least part of regions directly above the electrodes.

2. The ultraviolet light emitting device according to claim 1, wherein the first light-emitting layer has a thickness of less than 10 μm in the second regions.

3. The ultraviolet light emitting device according to claim 1, further comprising a thin film that is located between the first light-emitting layer and the dielectric layer and contains at least one selected from the group consisting of magnesium oxide, calcium oxide, barium oxide, and strontium oxide.

4. The ultraviolet light emitting device according to claim 1, wherein the first light-emitting layer contains powdered magnesium oxide that emits the ultraviolet light.

5. The ultraviolet light emitting device according to claim 4, wherein the first light-emitting layer further contains a halogen atom.

6. The ultraviolet light emitting device according to claim 5, wherein the halogen atom is fluorine.

7. The ultraviolet light emitting device according to claim 1, wherein the second substrate has a first main surface facing the first substrate and a second main surface opposite to the first main surface, and the ultraviolet light emitting device further includes a third light-emitting layer that is located directly or indirectly on the first or second main surface of the second substrate and emits the ultraviolet light.

8. The ultraviolet light emitting device according to claim 1, wherein the gas contains neon and xenon.

9. The ultraviolet light emitting device according to claim 1, wherein the ultraviolet light has a peak wavelength in the range of 200 to 300 nm.

10. The ultraviolet light emitting device according to claim 1, wherein the second regions include all regions directly above the electrodes.

* * * * *